US007410046B2

(12) United States Patent
Shiroza

(10) Patent No.: US 7,410,046 B2
(45) Date of Patent: Aug. 12, 2008

(54) WORK TRANSFER DEVICE FOR PRESS MACHINES

(75) Inventor: Kazuhiko Shiroza, Komatsu (JP)

(73) Assignee: Komatsu Ltd., Tokyo (JP)

( * ) Notice: Subject to any disclaimer, the term of this patent is extended or adjusted under 35 U.S.C. 154(b) by 146 days.

(21) Appl. No.: 10/574,869

(22) PCT Filed: Oct. 13, 2004

(86) PCT No.: PCT/JP2004/015077

§ 371 (c)(1),
(2), (4) Date: Apr. 6, 2006

(87) PCT Pub. No.: WO2005/035165

PCT Pub. Date: Apr. 21, 2005

(65) Prior Publication Data

US 2007/0051157 A1 Mar. 8, 2007

(30) Foreign Application Priority Data

Oct. 14, 2003 (JP) ..... 2003-354256

(51) Int. Cl.
*B65G 47/34* (2006.01)

(52) U.S. Cl. ..... 198/468.4; 198/621.1; 198/468.8

(58) Field of Classification Search ..... 198/621.1, 198/468.01, 468.4, 468.6, 468.8, 468.9
See application file for complete search history.

(56) References Cited

U.S. PATENT DOCUMENTS 4,540,087 A * 9/1985 Mizumoto ..... 198/621.1
4,785,657 A * 11/1988 Votava ..... 198/621.1
5,072,823 A * 12/1991 Takahashi et al. ..... 198/468.4
6,050,124 A 4/2000 Shiroza
6,170,641 B1 * 1/2001 Kuster ..... 198/468.2
6,543,604 B1 * 4/2003 Pung et al. ..... 198/468.4

(Continued)

FOREIGN PATENT DOCUMENTS

DE 199 02 998 B4 4/2007

(Continued)

OTHER PUBLICATIONS

Notification Concerning Transmittal of International Preliminary Report on Patentability, Chapter I of the Patent Cooperation Treaty, and Written Opinion of the International Searching Authority, for PCT/JP2004/015077, 4 sheets.

*Primary Examiner*—James R Bidwell
(74) *Attorney, Agent, or Firm*—Frishauf, Holtz, Goodman & Chick, P.C.

(57) ABSTRACT

A transfer feeder 41 for a transfer press 1 comprises a pair of bars 14 provided on a moving bolster 30 in parallel with a work transfer direction, a feed carrier 52 held by the bars 14 and movable in the work transfer direction, a clamp carrier 62 held by the feed carrier 52 and movable in the direction of clamp, and a lift carrier 72 supported by the clamp carrier 62 and movable in the direction of lift. Since a large drive mechanism is unnecessary, simplification of the construction can be enhanced. Further, since the whole of a transfer feeder 41 is provided on a moving bolster 30, the moving bolster 30 in its entirety can be carried out of the transfer press 1, thus facilitating die exchanging operation.

22 Claims, 15 Drawing Sheets

U.S. PATENT DOCUMENTS

2002/0144533 A1 10/2002 Shiroza

FOREIGN PATENT DOCUMENTS

JP 5-200464 A 8/1993
JP 6-269874 A 9/1994
JP 10-314871 A 12/1998
JP 10-328766 A 12/1998
JP 11-104759 A 4/1999
JP 2002-307116 A 10/2002
JP 2003-205330 A 7/2003

* cited by examiner

WORK TRANSFER DEVICE FOR PRESS MACHINES

This application is a U.S. National Phase Application under 35 U.S.C 371 of International Application PCT/JP2004/015077 filed Oct. 13, 2004.

TECHNICAL FIELD

The present invention relates to a work transfer device for press machines.

BACKGROUND ART

FIG. 17 shows a transfer press 100 as a conventional press machine. As shown in FIG. 17, four uprights 121 are erected on a bed 123 located in a lower portion of a press frame 110 of the transfer press 100, and a crown 120 is provided above the uprights 121. A slide drive device is built into the crown 120 for driving a slide 122 disposed below the crown 120 so that the slide 122 moves upward and downward. Upper dies 112 are attached to a lower surface of the slide 122. Lower dies 113 are attached to an upper surface of a moving bolster 130 opposed to the slide 122, so that a work is press-formed by cooperation of the upper dies 112 with the lower dies 113. A pair of bars 114, 114 are provided on the right and left with the upper dies 112 and the lower dies 113 sandwiched therebetween, the pair of bars 114, 114 extending in parallel. The feed bars 114, 114 are provided with fingers (not shown) faced to each other for holding a work (not shown). By appropriately reciprocating the feed bars 114, 114 in a feed direction, a lift direction and a clamp direction, the work is sequentially transferred from the lower die 113 on an upstream side (the left side in FIG. 17) to the lower die 113 on a downstream side (the right side in FIG. 17). Incidentally, the feed direction means the direction in parallel with the work transfer direction, and motions in the feed direction include an advance motion (a motion from the upstream side toward the downstream side) and a return motion (a motion from the downstream side toward the upstream side). Further, the lift direction means vertical direction, and motions in the lift direction include a lift motion (a motion from the lower side to the upper side) and a down motion (a motion from the upper side to the lower side). Further, the clamp direction means a horizontal direction perpendicular to the feed direction (namely, the direction vertical to the paper surface in the FIG. 17), and motions in the clamp direction include a clamp motion (a motion for decreasing the distance between two feed bars 114) and a unclamp motion (a motion for increasing the distance between two feed bars 114).

Further, in the case of a three-dimensional transfer feeder, by repeating clamp operation, lift operation, advance operation, down operation, unclamp operation and return operation to the feed bar 114, the work is sequentially transferred to the lower die 113 on the downstream side.

A feed drive section 115 for moving the feed bar 114 in the feed direction is fixed on the lateral surface of the press frame 110 on the upstream side (or downstream side). A clamp drive section 116, which moves the feed bar 114 in the clamp direction, and a lift drive section 117, which moves the feed bar 114 in the lift direction, are provided on the bed 123 between the right and left uprights 121.

The feed drive section 115, the clamp drive section 116, and the lift drive section 117 respectively rotate a feed cam, a clamp cam and a lift cam with the rotating power fetched from a press main body, so that the feed bar 114 is driven by these cams to perform three-dimensional motion in the feed direction, the clamp direction, and the lift direction.

When performing die exchanging, the fingers also need to be changed so as to be suitable to the next dies. At this time, since the finger exchanging is performed by an external setup similar to the die exchanging, the fingers need to be mounted on the moving bolster 130 together with the feed bar 114 so as to be moved out from the work transferring area. The feed bars 114 can be split into a fixed part and a movable part, the fixed part being in a position to interfere with the uprights 121 while the feed bars 114 are being moved out from the work transferring area, the movable part capable of being mounted on the moving bolster 130 so as to be moved out from the work transferring area. When performing the die exchanging, the movable part is split from the fixed part, and only the movable part is moved out from the work transferring area along with the moving bolster 130 so as to perform the finger exchanging.

However, in the case of the movements in the feed direction, the clamp direction, and the lift direction are driven by the respective cams, to obtain a variable motion pattern of the feed bar 114, plural cams are needed according to the motion pattern, therefore not only the drive mechanism becomes complicated and expensive, but also the variable motion pattern is limited by the number of the cams. Thus recently there is a desire to easily obtain various motion patterns with a simple drive mechanism.

Thus a work transfer device is proposed, of which the feed drive section 115, the clamp drive section 116, and the lift drive section 117 are driven by respective servomotors, and the servomotors are controllable.

The feed drive section 115, the clamp drive sections 1 16, and the lift drive section 117, all these driving by means of servomotors, have the following configuration. The feed drive section 115 is provided with a ball screw mechanism, which uses a first servomotor as driving source, for reciprocating the feed bar 114 in the feed direction. The clamp drive section 116 is provided with a ball screw mechanism, which uses a second servomotor as driving source, for reciprocating the feed bar 114 in the clamp direction. The lift drive section 117 is provided with a rack and pinion mechanism, which uses a third servomotor as driving source, for reciprocating the feed bar 114 in the lift direction.

Further, as described in Patent Document 1, all of the feed operation, the clamp operation, and the lift operation of the feed bar also can be driven by linear motors. In such a work transfer device, the feed bar is suspended from a bracket fixed to the press main body. The linear motor is provided between the bracket and the feed bar, and the feed bar moves in the feed direction relative to the bracket so as to perform the feed operation. Also, the clamp operation and the lift operation are driven by respective linear motors provided on the lower surface of the feed bar.

Further, Patent Document 2 describes a work transfer device in which a fixed bar is provided with a first bracket which is driven by a linear motor so as to perform lift operation, the first bracket is provided with a second bracket which is driven by a linear motor so as to perform clamp operation, and the second bracket is provided with a third bracket with a work holder installed thereon, the third bracket being driven by a linear motor so as to perform feed operation.

Further, Patent Document 3 describes a work transfer device having a pair of lift beams arranged in parallel with the work transfer direction and capable of being freely moved in the vertical direction, a carrier provided on each lift beam and capable of being moved in the longitudinal direction of the lift beam by means of a linear motor, sub-carriers provided on the carrier and capable of being moved along a guide of the carrier in the carrier moving direction by means of a linear motor; and a cross bar spanning over the pair of oppositely facing sub-carriers and having a work holder. In such a work transfer device, the lift operation is performed by moving the lift beams by means of a servomotor. Further, the feed operation is performed by moving the carrier and the sub-carriers in the feed direction by means of a linear motor. Owing to the carrier and the sub-carriers, the moving range in the feed direction can be widened.

[Patent Document 1] Japanese Patent Laid-Open Publication No. Hei10-314871 (Page 4 and FIG. 5)

[Patent Document 2] Japanese Patent Laid-Open Publication No. Hei11-104759 (Pages 2 to 3, FIG. 3, and FIG. 4)

[Patent Document 3] Japanese Patent Laid-Open Publication No. 2003-205330 (Page 5 and FIG. 5)

DISCLOSURE OF THE INVENTION

[Problems to be Solved by the Invention]

However, in the conventional transfer press as shown in FIG. 17, since the feed box with the feed drive section 115 housed therein is arranged on a lateral surface of the press main body, and since a lift box and a clamp box, respectively having the lift drive section 1 17 and the clamp drive section 1 16 housed therein, are arranged between the right and left uprights 121, not only the drive mechanism becomes complicated, but also the manufacturing cost is increased.

Further, since the feed box with the feed drive section 115 housed therein projects from the lateral surface of the press main body, not only it can be obstructive in the case where a material supply device or a work carrying-out robot is wanted to be installed, but also a wide installation space is required for press line.

Further, with the art described in Patent Document 1, since the feed bar in its entirety is driven in the feed direction, the total weight to be driven becomes large. Thus a driving source having larger capacity is necessary to follow the production speed of pressing, so that the manufacturing cost is increased.

Further, with the art described in Patent Document 2, since the second bracket is provided with a third bracket which performs feed operation driven by a linear motor, the length of the second bracket in the feed direction has to be large to ensure feed distance. Thus the second bracket becomes large and heavy, and the second bracket has to perform clamp operation relative to the first bracket. Further, the first bracket, which holds the second bracket, has to perform lift operation relative to the fixed bar. Thus linear motors having larger capacity will necessarily be used for the driving mechanism for performing clamp operation and lift operation, so that the manufacturing cost is increased.

Further, with the art described in Patent Document 3, though the moving range in the feed direction can be widened, a carrier capable of being moved by a linear motor and sub-carriers capable of being moved by a linear motor will be necessary. Thus the number of the linear motor for feeding the work is increased, therefore not only the construction becomes complicated, but also the manufacturing cost is increased.

As according to the above, though the servomotor or other methods are employed, the effect for simplifying the construction is not enough, simplified construction and reduced cost are further desired.

Further, in the conventional transfer press as shown in FIG. 17, the moving bolster 130 needs to be drawn outward from the press main body when performing die exchanging. Since the finger for holding the work also needs to be exchanged at the same time, the connector (not shown) of the feed bar 114 needs to be released to split the movable part from the fixed part while the feed bar 114 is mounted on the bar receiving table of the moving bolster 130. Thus the die exchanging operation becomes complicated, and the time for performing the die exchanging can not be shortened.

In view of the aforementioned problems, it is an object of the present invention to provide a work transfer device for press machines having simple structure and capable of facilitating die exchanging operation.

[Means for Solving the Problems]

In order to solve the aforementioned problems, according to a first aspect of the present invention, it is provided a work transfer device for press machines which includes: a pair of bars provided on a moving bolster in parallel with a work transfer direction; a feed carrier held by the bars; a feed drive mechanism provided on the moving bolster, the feed drive mechanism driving the feed carrier in the work transfer direction; a base held by the feed carrier; a lift drive mechanism provided on the moving bolster, the lift drive mechanism driving the base in a lift direction so that the base moves vertically; and a work holder detachably attached to the base for holding a work.

According to a second aspect of the present invention, the work transfer device for press machines according to the first aspect of the present invention is further provided with a clamp drive mechanism provided on the moving bolster, the clamp drive mechanism driving the base in a clamp direction perpendicular to the work transfer direction.

According to a third aspect of the present invention, in the work transfer device for press machines according to the first aspect or the second aspect of the present invention, at least one of the feed drive mechanism and the lift drive mechanism is provided with a linear motor.

According to a fourth aspect of the present invention, in the work transfer device for press machines according to the second aspect of the present invention, the clamp drive mechanism is provided with a linear motor.

According to a fifth aspect of the present invention, in the work transfer device for press machines according to the first aspect or the second aspect of the present invention, at least one of the feed drive mechanism and the lift drive mechanism is provided with a servomotor.

According to a sixth aspect of the present invention, in the work transfer device for press machines according to the second aspect of the present invention, the clamp drive mechanism is provided with a servomotor.

According to a seventh aspect of the present invention, in the work transfer device for press machines according to any one of the first aspect to sixth aspect of the present invention, a plurality of the feed carriers are held by the bars, a motion of the each feed carrier being individually controllable.

According to an eighth aspect of the present invention, in the work transfer device for press machines according to any one of the first aspect to sixth aspect of the present invention, a plurality of the feed carriers are held by the bars, adjacent ones of the plurality of the feed carriers being connected to each other by a connector.

According to a ninth aspect of the present invention, in the work transfer device for press machines according to any one of the first aspect to sixth aspect of the present invention, a plurality of the work holders for plural working processes are detachably attached to the base.

According to a tenth aspect of the present invention, the work transfer device for press machines according to any one of the first aspect to ninth aspect of the present invention is further provided with a bar-interval adjusting device for adjusting an interval between the pair of bars.

According to an eleventh aspect of the present invention, in the work transfer device for press machines according to any one of the first aspect to tenth aspect of the present invention, the feed carrier can be moved to a position where the work holder is not projected from the moving bolster in a plan view of the press machine.

[Effect of the Invention]

According to the first aspect of the present invention, the feed carrier is driven by the feed drive mechanism so as to move relative to the pair of the bars in the work transfer direction. Further, the base is driven by the lift drive mechanism so as to move relative to the feed carrier in the lift direction. Thus the work transfer device can perform at least two-dimensional motion in the work transfer direction and the lift direction.

Since the feed carrier moves relative to the bars in the work transfer direction, the moving range of feed carrier the in the work transfer direction becomes wide. Also, since the moving distance in the lift direction is usually smaller than the moving distance in the work transfer direction, the length of the feed carrier in the lift direction becomes small. Thus the feed carrier can be made small and light, and the feed drive mechanism and lift drive mechanism with small capacity can be used, therefore it becomes possible to install the feed drive mechanism and lift drive mechanism on the moving bolster.

Accordingly, different from the conventional art, since the feed box having a feed drive section housed therein becomes unnecessary, there is no feed box projected from the press main body, so that the press device as a whole can be downsized. Further, since no feed box is projected, a work carrying-out robot or the like can be provided in the vicinity of the press machine. Further, since the lift box, which is arranged together with the feed box between the uprights and has a lift drive section housed therein, also becomes unnecessary, the construction of the work transfer device can be simplified.

Further, since the work transfer device, which includes the feed drive mechanism and the lift drive mechanism, is installed in its entirety on the moving bolster, the work transfer device can be moved in its entirety together with the moving bolster when performing die exchanging. Thus, different from the conventional art, the bar needs not to be separated so as not to interfere with the uprights, or to be moved to a height position where movement of the moving bolster is not disturbed, therefore not only the construction of the bar is simplified, but also the die exchanging operation is facilitated.

Herein the lift direction means a direction perpendicular to a plane including the pair of the bars.

Note that the case of installing the feed drive mechanism and lift drive mechanism on the moving bolster not only includes the case where the feed drive mechanism and lift drive mechanism are directly installed on the moving bolster, but also includes the case where the feed drive mechanism and lift drive mechanism are indirectly installed via a member mounted on the moving bolster.

According to the second aspect of the present invention, due to the provision of the clamp drive mechanism for driving the base, the bar can move in a clamp direction. Thus the work transfer device can perform three-dimensional motion in the feed direction, the lift direction, and the clamp direction with the feed drive mechanism, the lift drive mechanism, and the clamp drive mechanism. Thus it becomes possible to cope with various kinds of press working, so that versatility of the transfer press can be expanded.

Herein the clamp direction means a horizontal direction perpendicular to the work transfer direction, namely a direction in which the pair of bars move toward or away from each other.

According to the third aspect of the present invention, since at least one of the feed drive mechanism and the lift drive mechanism is provided with a linear motor, non-contact movement becomes possible, and also since the there is no rotating portion, not only the endurance of the work transfer device can be improved, but also driving noise can be reduced. Further, since the linear motor is employed, not only wide installation space becomes unnecessary, but also high-speed carry and high-precision positioning can be realized.

According to the fourth aspect of the present invention, since the clamp drive mechanism is provided with the linear motor, non-contact movement becomes possible, and also since the there is no rotating portion, not only the endurance of the work transfer device can be improved, but also driving noise can be reduced. Further, since the linear motor is employed, not only wide installation space becomes unnecessary, but also high-speed carry and high-precision positioning can be realized.

According to the fifth aspect of the present invention, since at least one of the feed drive mechanism and the lift drive mechanism is provided with a servomotor, the cost for the feed drive mechanism and the lift drive mechanism is reduced, and since the conventional mechanism such as a ball screw mechanism, a rack and pinion mechanism or the like can be used for the power transmitting mechanism, maintenance and the adjustment of the work transfer device and the press machine become easy.

According to the sixth aspect of the present invention, since the clamp drive mechanism is provided with a servomotor, the cost for the clamp drive mechanism is reduced, and since the conventional mechanism such as a ball screw mechanism, a rack and pinion mechanism or the like can be used for the power transmitting mechanism, maintenance and the adjustment of the work transfer device and the press machine become easy.

According to the seventh aspect of the present invention, since the motion of each feed carrier is individually controllable, the setting such as the moving distance and the moving timing of the feed carrier can be freely set corresponding to the die. Thus it is possible to flexibly cope with various kinds of press working, so that versatility of the transfer press can be expanded.

According to the eighth aspect of the present invention, since the feed carriers adjacent to each other are connected to each other via a connector, when one feed carrier is driven, other feed carriers connected via the connector will be driven too at the same time in the work transfer direction. Thus it is unnecessary to provide a feed drive mechanism for each of the feed carriers, therefore not only the cost can be reduced, but also the structure and control can be further simplified.

According to the ninth aspect of the present invention, since a plurality of the work holders for plural processes are detachably attached to the base, in a transfer press having plural working processes, for example, the number of the feed carrier and the number of the lift carrier and the clamp carrier, both moving together with the feed carrier, can be reduced, therefore the cost can be reduced. Thus the structure and control can be further simplified.

According to the tenth aspect of the present invention, due to the provision of the bar-interval adjusting device, the interval between the pair of bars can be adjusted to an optimal value. Further, in the case that the work transfer device has a clamp drive mechanism, when setting a maximum moving distance of the clamp drive mechanism, since the dimension of the bar interval need not to be added to the maximum moving distance (maximum clamp amount), the maximum moving distance of the clamp drive mechanism can be reduced. Thus the weight of the base can be reduced. Further, when exchanging the die mounted on the moving bolster while performing the die exchanging operation in the outside of the press machine, since the bar interval can be automatically widened with the bar-interval adjusting device, die exchanging operation is further facilitated.

According to the eleventh aspect of the present invention, the work holder located behind the uprights for carrying-in/out the work in the idle process can be exchanged by an external setup without employing any special device. Thus the die exchanging operation is facilitated.

EXPLANATION OF CODES

1 . . . transfer press (press machine), 14, 14A . . . bar, 30, 30A . . . moving bolster, 31 . . . bolster, 40, 40A . . . bar-interval adjusting device, 41, 41A, 41B, 41C . . . transfer feeder (work transfer device), 50, 50A . . . base, 52, 52A . . . feed carrier, 53 . . . feeding linear motor (feed drive mechanism), 53A . . . feeding servomotor (feed drive mechanism), 56 . . . connector, 62, 62A . . . clamp carrier, 63 . . . clamping linear motor (clamp drive mechanism), 63A . . . clamping servomotor (clamp drive mechanism), 72, 72A . . . lift carrier, 73 . . . lifting linear motor (lift drive mechanism), 73A . . . lifting servomotor (lift drive mechanism), 76 . . . finger (work holder), 77 . . . gripper (work holder), 81 . . . work.

BEST MODE FOR CARRYING OUT THE INVENTION

Embodiments of a work transfer device according to the present invention will be described below with reference to attached drawings.

First Embodiment

Figure 1:
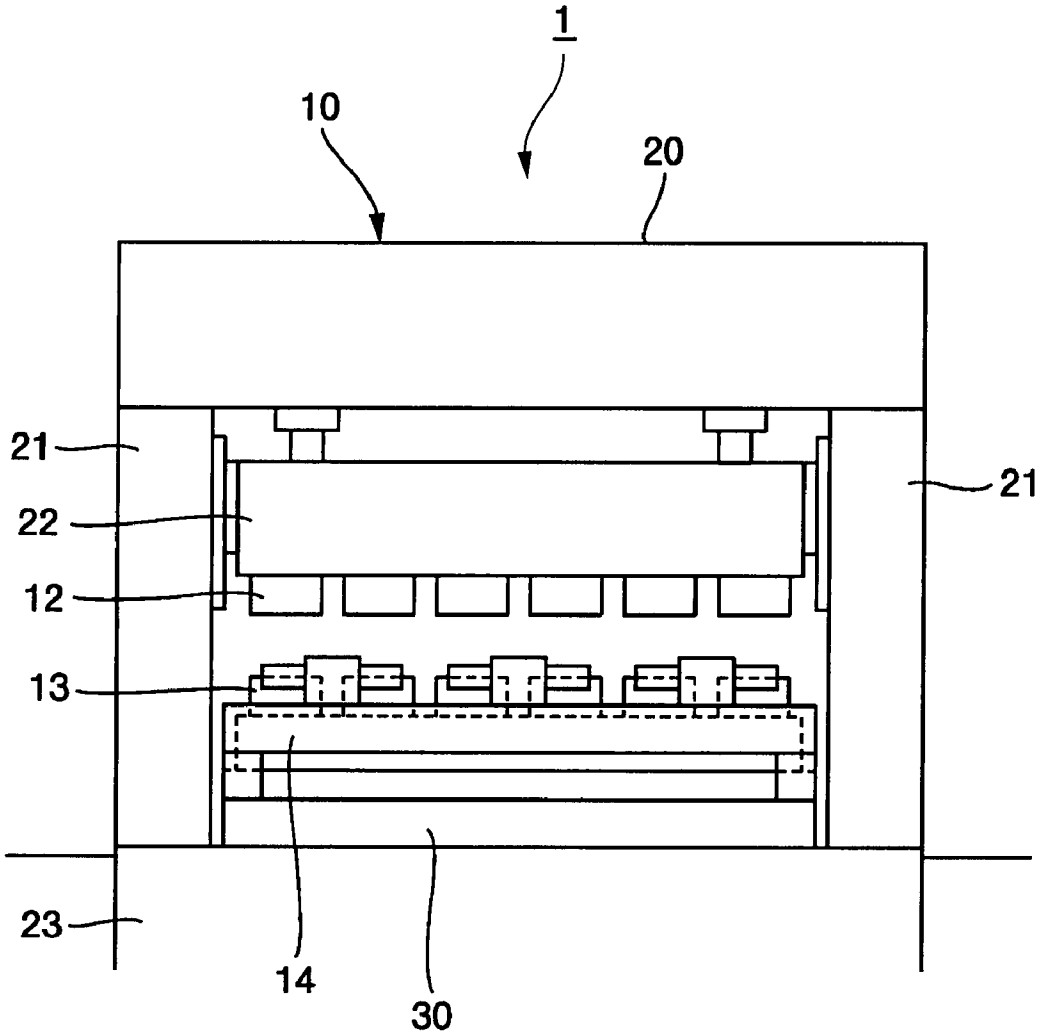
FIG. 1 is a front elevational view showing a press machine equipped with a work transfer device in a first embodiment of the present invention.
Figure 2:
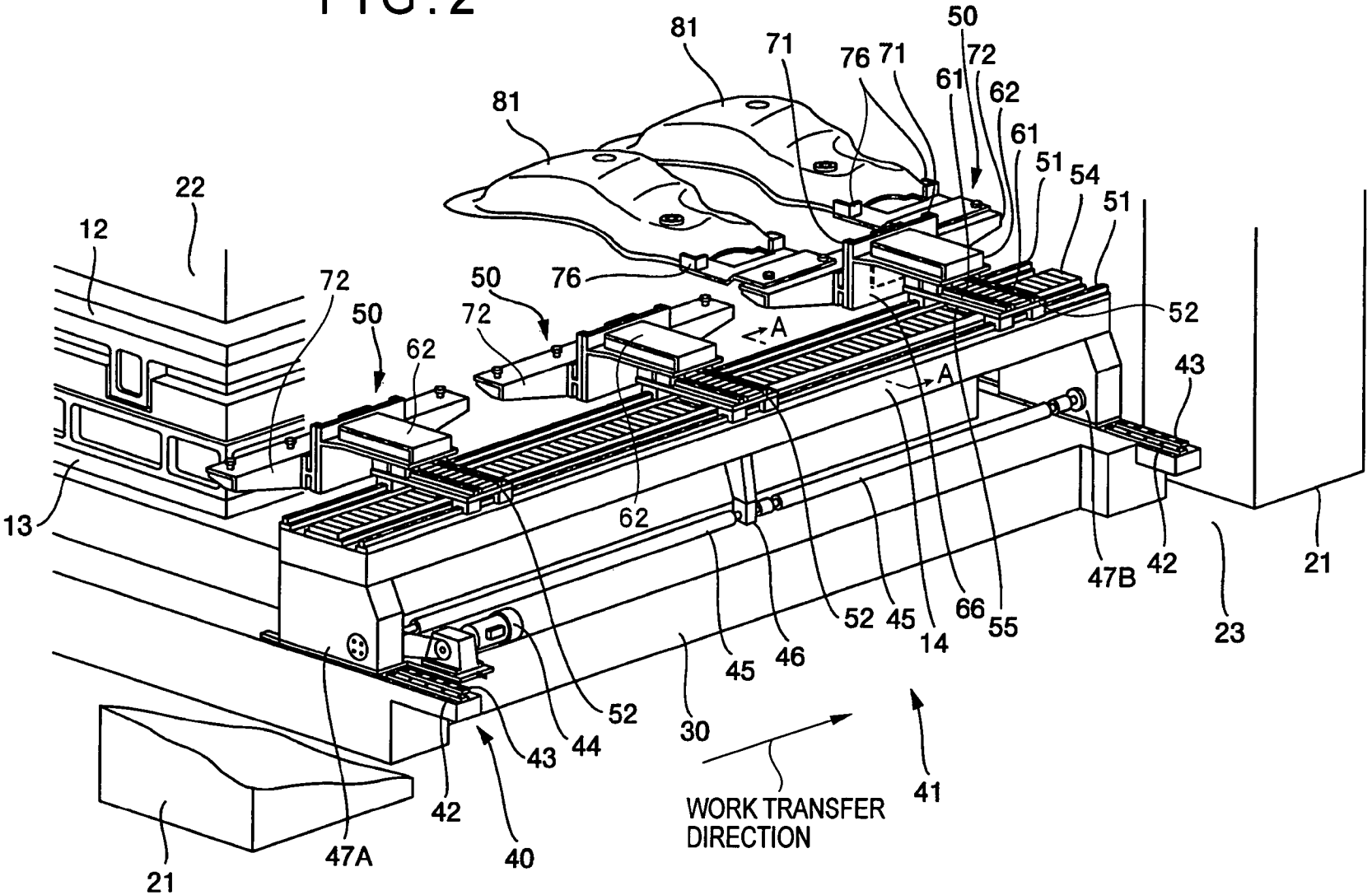
FIG. 2 is a perspective view showing the work transfer device in the first embodiment.
Figure 3:
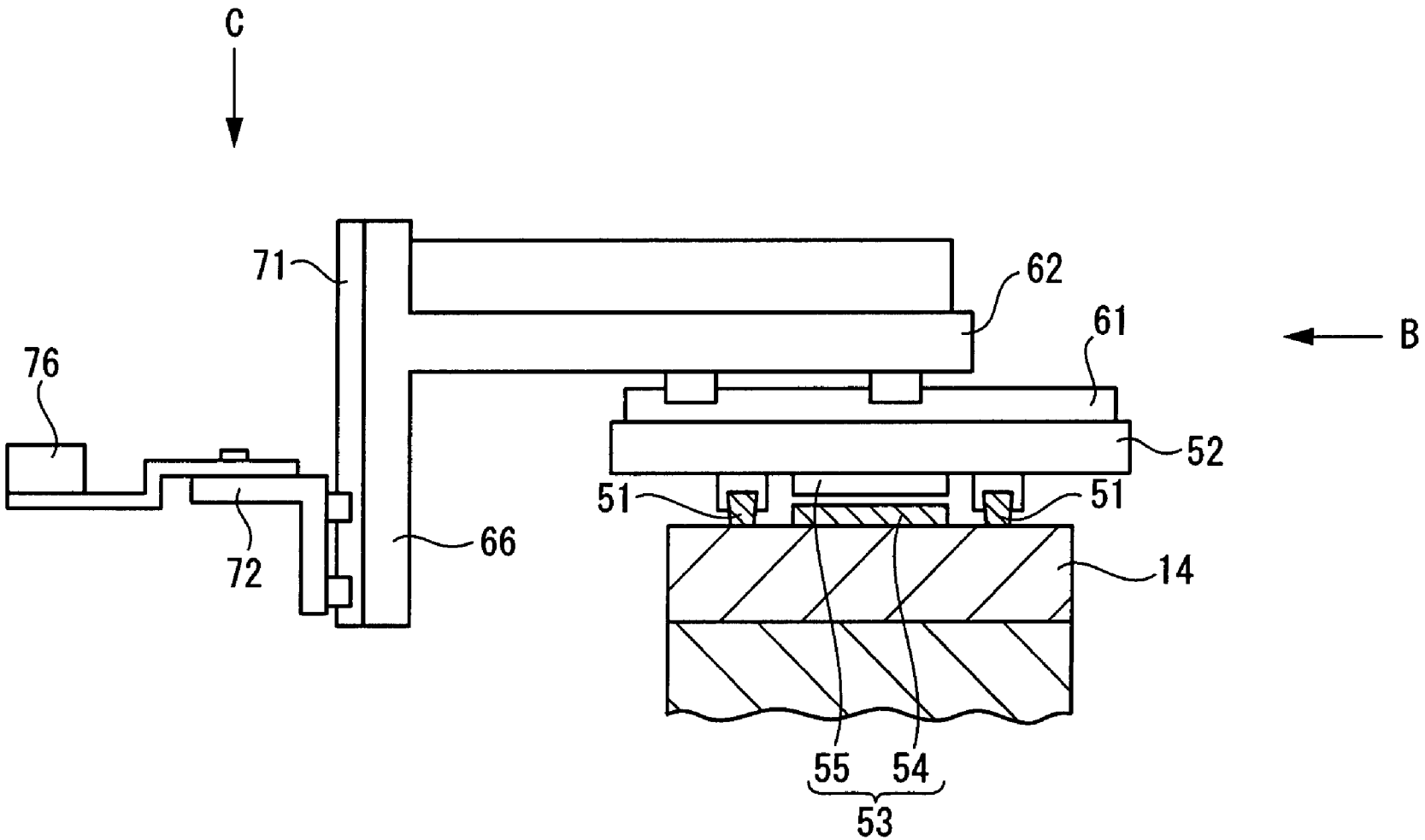
FIG. 3 is a cross section taken along line A-A of FIG. 2.
Figure 4:
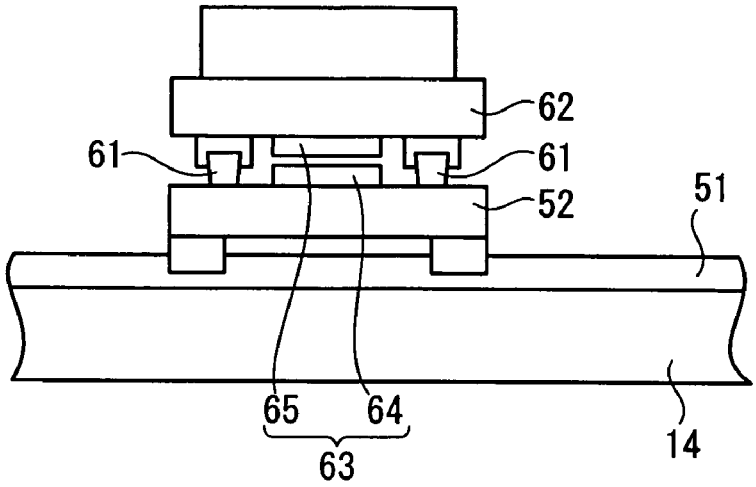
FIG. 4 is an elevational view viewed from the direction B of FIG. 3.
Figure 5:
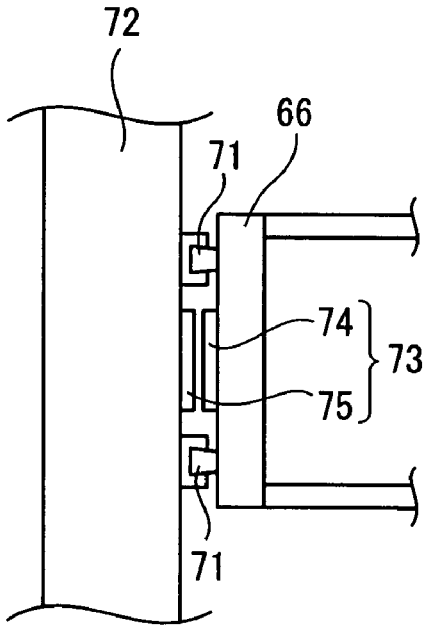
FIG. 5 is an elevational view viewed from the direction C of FIG. 3.

FIG. 1 is a front elevational view showing a transfer press (press machine) 1 equipped with a work transfer device in a first embodiment of the present invention. FIG. 2 is a perspective view showing a transfer feeder 41 which is the work transfer device. FIGS. 3 to 5 are partly enlarged views of the transfer feeder 41.

As shown in FIG. 1, four columnar uprights 21 are erected on a bed 23 disposed in the lower portion of a press frame 10 of the transfer press 1, and a crown 20 is provided above the uprights 21. A slide drive device is built into the crown 20 for driving a slide 22 disposed below the crown 20 upward and downward. Upper dies 12 are attached to a lower surface of the slide 22. Lower dies 13 are attached to an upper surface of a moving bolster 30 opposed to the slide 22, so that a work is press-formed by cooperation of the upper dies 12 with the lower dies 13. Above the moving bolster 30, a pair of bars 14, 14 are provided on the right and left with the upper dies 12 and the lower dies 13 sandwiched therebetween, the pair of bars 14, 14 extending in parallel in the work transfer direction.

To make the description easy to understand, only one of the pair of the bars 14, 14 is showed in FIG. 2. As shown in FIG. 2, the front side (seen from FIG. 2) of the automatically movable moving bolster 30 is provided with moving rails 42, 42 respectively in two end portions, the moving rails 42, 42 extending in a horizontal direction perpendicular to the transfer direction (the longitudinal direction of the bars 14, 14) of the work. Supports 47A, 47B, which are respectively disposed below two end portions of the bar 14, are provided so as to be movable along the moving rails 42, 42. Racks 43, 43 are provided near the moving rails 42, 42. Pinions (not shown) respectively provided in the supports 47A, 47B engage with the racks 43, 43, the pinions being linked with each other via drive shafts 45, 45 rotatably supported by a central support 46.

When the pinions rotate, chain-driven by a moving motor 44 provided on the support 47A in one end portion of the bar 14, since the pinions respectively engage with racks 43, 43, the bar 14 can move together with the supports 47A, 47B toward or away from the other bar 14. In this manner a bar-interval adjusting device 40 of the present invention, which can adjust the interval between the pair of bars 14, 14 (i.e., the bar 14 on the front side and the bar 14 on the back side seen from FIG. 2), is formed by the moving rails 42, 42, the racks 43, 43, the pinions, the supports 47A, 47B, the central support 46, the drive shafts 45, 45, and the moving motor 44. It is possible to flexibly cope with various kinds of press working by adjusting, with the bar-interval adjusting device 40, the interval between the pair of bars 14, 14 according to the die, therefore versatility of the transfer press 1 can be expanded.

A pair of feeding rails 51, 51 are provided on an upper surface of the bar 14, and a plurality of feed carriers 52 are movably provided on the pair of feeding rails 51, 51. Though there are three feed carriers 52 in the first embodiment, the number of the feed carrier 52 can be one, two, four or more than four according to necessity. The feed carrier 52, driven by a feeding linear motor (feed drive mechanism) 53 (refer to FIG. 3), performs a feed operation. Herein, the feed operation means an operation in which the feed carrier 52 moves along a feed direction. Further, the feed direction means a direction parallel to the work transfer direction.

As also shown in FIG. 3, the feeding linear motor 53 has a magnet plate 54 as a fixed part provided between the pair of the feeding rails 51, 51, and a coil plate 55 as a movable part provided on a lower surface of the feed carrier 52, the coil plate 55 being opposed to the magnet plate 54. When a current flows so that a shifting magnetic field is generated to the coil plate 55, the coil plate 55 will move due to the attraction and repulsion force against the magnet plate 54. The feed carrier 52 is moved along with the coil plate 55, thus the feed carrier 52 is forced to perform a feed operation. Herein, the respective feed carriers 52 are individually movably provided on the feeding rails 51, 51, and the movement of the respective feed carriers 52 can be individually controlled.

As shown in FIGS. 2 and 3, a pair of clamping rails 61, 61 are provided on an upper surface of the feed carrier 52 in a horizontal direction perpendicular to the feeding rail 51, and a clamp carrier 62 is movably provided on the pair of clamping rails 61, 61. The clamp carrier 62, driven by a clamping linear motor (clamp drive mechanism) 63 (refer to FIG. 4), performs a clamp operation. Herein, the clamp operation means an operation in which the clamp carrier 62 moves along a clamp direction. Further, the clamp direction means a horizontal direction perpendicular to the feed direction, namely a direction in which a pair of opposed clamp carriers 62 move toward or away from each other.

As also shown in FIGS. 3 and 4, the clamping linear motor 63 has a magnet plate 64 as a fixed part provided between the pair of the clamping rails 61, 61, and a coil plate 65 as a movable part provided on a lower surface of the clamp carrier 62, the coil plate 65 being opposed to the magnet plate 64. When a current flows so that a shifting magnetic field is generated to the coil plate 65, the coil plate 65 will move due to the attraction and repulsion force against the magnet plate 64. The clamp carrier 62 is moved along with the coil plate 65, thus the clamp carrier 62 is forced to perform clamp operation.

A pair of lifting rails 71, 71 extending in the vertical direction are provided on a back-side surface (seen from FIG. 2) of the L-shaped bracket 66 of the clamp carrier 62, and a lift carrier 72 is movably provided on the pair of lifting rails 71, 71. The lift carrier 72, driven by a lifting linear motor (lift drive mechanism) 73 (refer to FIG. 5), performs a lift operation. Herein, the lift operation means an operation in which the lift carrier 72 moves along a lift direction. Further, the lift direction means a direction perpendicular to both the feed direction and the clamp direction, namely a direction in which the lift carrier 72 moves vertically.

As also shown in FIGS. 3 and 5, the lifting linear motor 73 has a magnet plate 74 as a fixed part provided between the pair of the lifting rails 71, 71, and a coil plate 75 as a movable part provided on a front-side surface (seen from FIG. 2) of the lift carrier 72, the coil plate 75 being opposed to the magnet plate 74. When a current flows so that a shifting magnetic field is generated to the coil plate 75, the coil plate 75 will move due to the attraction and repulsion force against the magnet plate 74. The lift carrier 72 is moved along with the coil plate 75, thus the lift carrier 72 is forced to perform lift operation.

Figure 6:
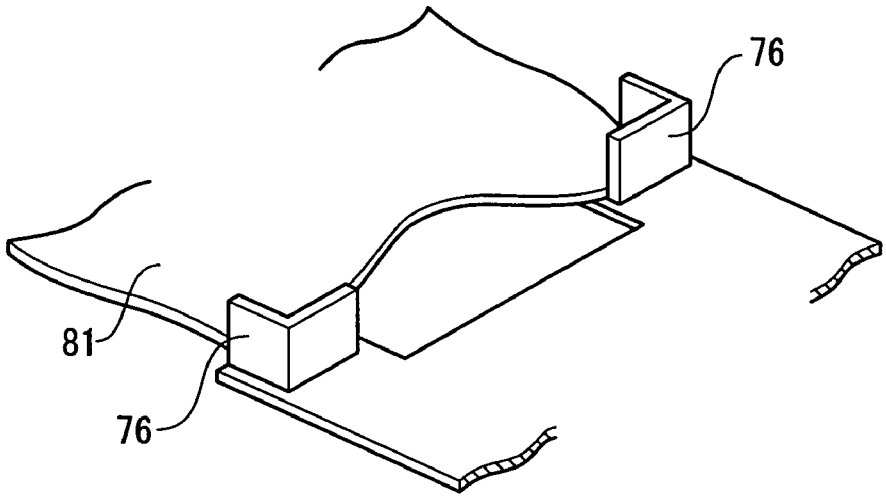
FIG. 6 is a perspective view showing a work holder.

A pair of fingers 76, 76 as work holders for holding works 81, 81 are detachably attached to the lift carrier 72. FIG. 6 is a perspective view showing a part of the pair of fingers 76, 76. As shown in FIG. 6, in the first embodiment, the lift carrier 72 is provided with plural pairs of fingers 76, 76 (the number of the pair corresponds to the number of working process, and in the first embodiment, the two pairs of the fingers are provided). By performing the clamp operation, two works 81, 81 (refer to FIG. 2) can be simultaneously clamped with the two pairs of fingers 76, 76 and the other two pairs of fingers 76, 76 (not shown) on the opposing side.

Herein, since the pair of fingers 76, 76 are provided to the lift carrier 72 and the lift carrier 72 is provided to the clamp carrier 62, the pair of fingers 76, 76 can move both in the lift direction and the clamp direction, so that the lift carrier 72 and the clamp carrier 62 are equivalents to a base 50 of the present invention.

Since the lift carrier 72 is provided with plural pairs of fingers 76, 76 to hold the plural works 81, the number of the lifting linear motor 73 can be reduced, the construction of the transfer feeder 41 can be simplified, and the manufacturing cost can be reduced.

Figure 7:
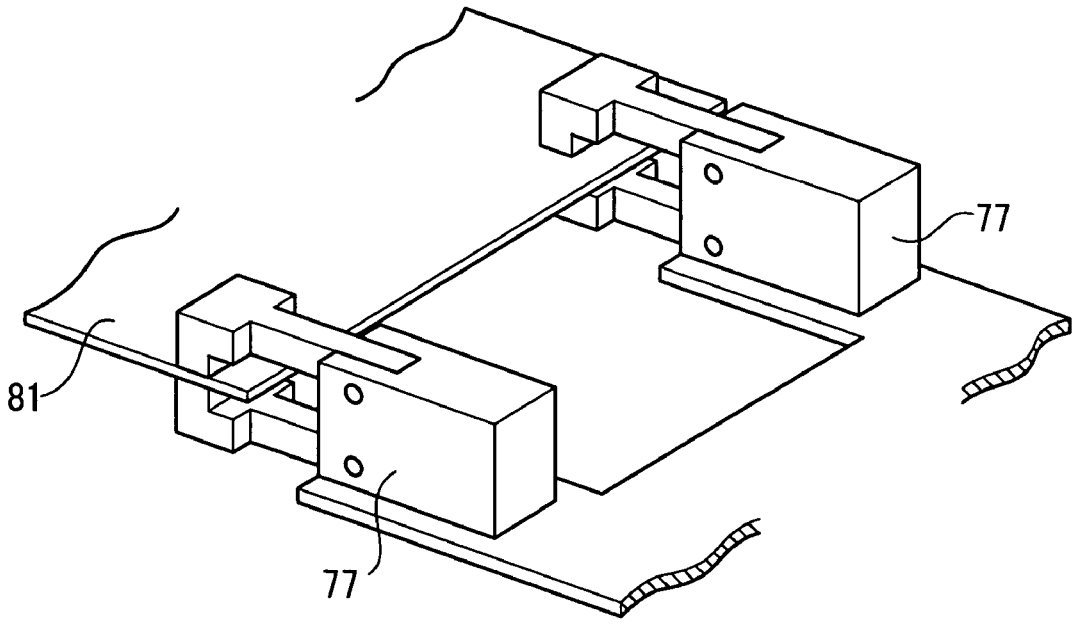
FIG. 7 is a perspective view showing a modification of the work holder.

Incidentally, in the first embodiment, though the pair of fingers 76, 76, which position and mount the work 81, are used for the work holder for holding the work 81, the work holder is not limited thereto, and, for example, a gripper 77 as shown in FIG. 7 for gripping the work 81 can be used. Further, in the first embodiment, though the lift carrier 72 is provided with two pairs of fingers 76, 76, the number of the fingers 76 can be one pair, three pairs, or more than three pairs corresponding to the die.

Similar to the described above, the other bar 14 (not shown) on the back side (seen from FIG. 2) is opposingly provided with feed carriers 52, clamp carriers 62, and lift carriers 72, and all these components respectively perform, driven by respective linear motors, the feed operation (for performing a movement parallel to the work transfer direction), the clamp operation (for performing a horizontal movement perpendicular to the feed direction), and the lift operation (for performing a movement in the vertical direction).

Further, though the embodiment is described based on the configuration in which the magnet plate of the linear motor is a fixed part and the coil plate is a movable part, the configuration also can be the one in which the magnet plate of the linear motor is a movable part and the coil plate is a fixed part.

Figure 8:
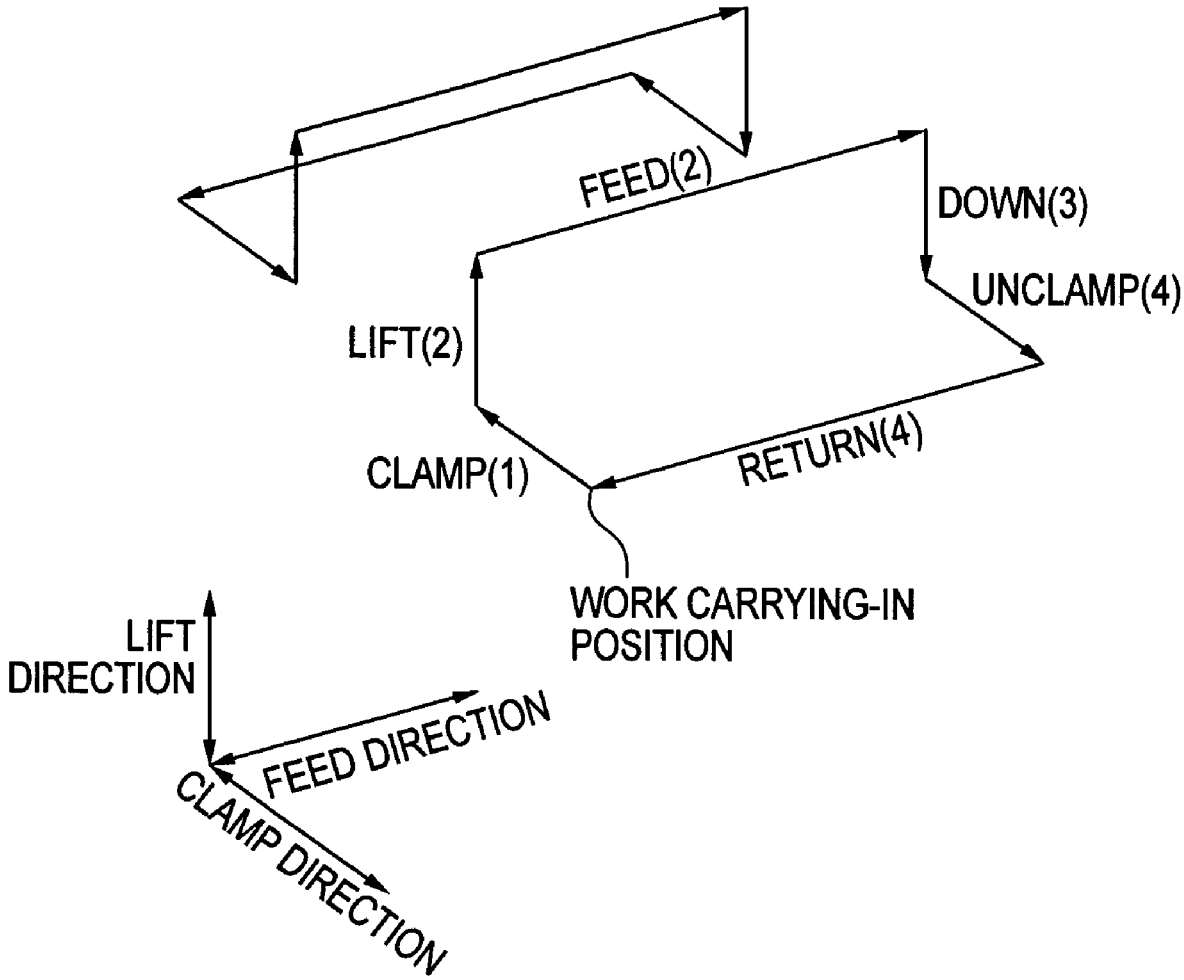
FIG. 8 is an illustration explaining the motion of the work holder of the first embodiment.

The operation of the work transfer device in the first embodiment will be described below with reference to FIG. 2 and FIG. 8 that explains the motion of the first embodiment. The operation will be described based on a case where a work is transferred from a first working process to a second working process.

(1) First, the work 81 is pressed in the first working process, and the slide 22 starts to rise.

At this time, the lift carrier 72 with the fingers 76 fixed thereon is located in a down position (at the downward end of a lift stroke). Further, the clamp carrier 62 that holds the lift carrier 72 is located in an unclamp position (at outward end of a clamp stroke). When the clamp carrier 62 is driven by the clamping linear motor 63, the clamp carrier 62 performs a clamp motion along the clamping rails 61, 61 from the unclamp position toward a clamp position (at inward end of the clamp stroke), so that the work 81 on the lower die 13 of the first working process is mounted on the fingers 76.

Next, in the state where the work 81 is mounted on the fingers 76, when the lift carrier 72 is driven by the lifting linear motor 73, the lift carrier 72 performs a lift motion from the down position to a lift position (at the upward end of the lift stroke) Further, when the feed carrier 52 is driven by the feeding linear motor 53, the feed carrier 52 that holds the clamp carrier 62 is subjected to a controlled drive to perform a feed motion. Consequently, the work 81 mounted on the fingers 76 is transferred from the first working process to the second working process.

(3) Upon the work 81 reaches the second working process, the lift carrier 72 is driven by the lifting linear motor 73, so that the lift carrier 72 is moved to the down position to set the work 81 onto the lower die 13 of the second working process.

(4) After the work 81 is set onto the lower die 13, when the clamp carrier 62 is driven by the clamping linear motor 63, the clamp carrier 62 performs an unclamp motion from the clamp position to the unclamp position, so that the fingers 76 are retreated from the work 81. Further, when the feed carrier 52 is driven by the feeding linear motor 53, the feed carrier 52 performs a return motion from the second working process toward the first working process until reaching the initial first working process again.

Incidentally, after the fingers 76 are moved to the unclamp position to retreat from the area of interfering with the upper die 12, the slide 22 is descended, so that a predetermined press working of the second working process is performed by clamping the work 81 between the upper die 12 attached on the lower surface of the slide 22 and the lower die 13 and applying pressure.

As described above, the transfer feeder 41 of the first embodiment is provided with the feed carrier 52 movable relative to the bar 14 in the feed direction, the clamp carrier 62 movable relative to the feed carrier 52 in the clamp direction, and the lift carrier 72 movable relative to the clamp carrier 62 in the lift direction. All these components are driven by the respective linear motors so as to respectively perform, in a reciprocating manner, the feed/return motion in the feed direction, the clamp/unclamp motion in the clamp direction (the horizontal direction perpendicular to the feed direction), and the rising/descending motion in the lift direction. All these motions constitute a three-dimensional operation. By appropriately reciprocating the work holder held on the lift carrier 72 in the feed direction, the lift direction and the clamp direction, the work 81 is sequentially transferred from the lower die 13 on an upstream side (left side in FIG. 1) to the lower die 13 on a downstream side (right side in FIG. 1).

Figure 9:
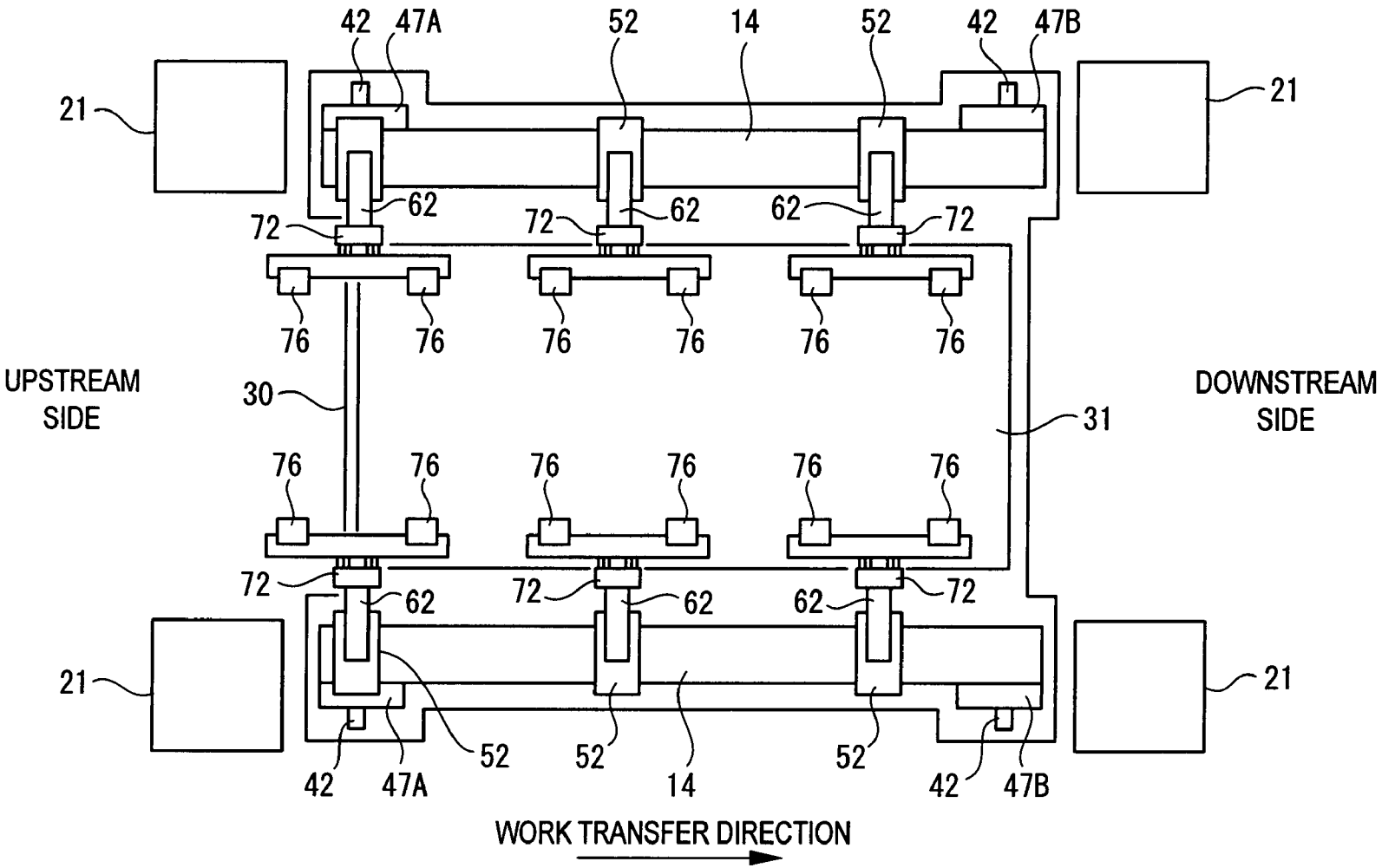
FIG. 9 is a top view showing a transfer feeder, which is the work transfer device of the first embodiment, before the time when a feed operation is performed.

FIG. 9 is a top view of the transfer press 1 illustrating the positions of the feed carriers 52 at the time when a work 81 is carried in from outside of the transfer press 1 toward the uppermost stream working process (the first working process in the present embodiment) of the transfer press 1. In FIG. 9, the fingers 76 in the uppermost stream are positioned outside a bolster 31 of the moving bolster 30, namely, are positioned at a location that is projected from the bolster 31 and the moving bolster 30, in the plan view of the transfer press 1 (namely when viewed from a direction vertical to the paper surface of FIG. 9). At this time, the fingers 76 in the uppermost stream are positioned on the upstream side relative to the downstream part of the two uprights 21 on the upstream side. This position is the position for performing an idle process for carrying-in work. On the other hand, at this time, the fingers 76 in the lowermost stream are positioned in the lowermost stream working process (the fifth working process in the present embodiment). In this state, when the works 81 are mounted on respective fingers 76, the material (the work 81) supplied from the outside of the transfer press 1 is mounted on the fingers 76 in the uppermost stream, and the works 81 finished with respective stages of working process are mounted on other fingers 76. In this state, the respective feed carriers 52 are moved in the feed direction, so that the works 81 are respectively transferred to the next working process.

Figure 10:
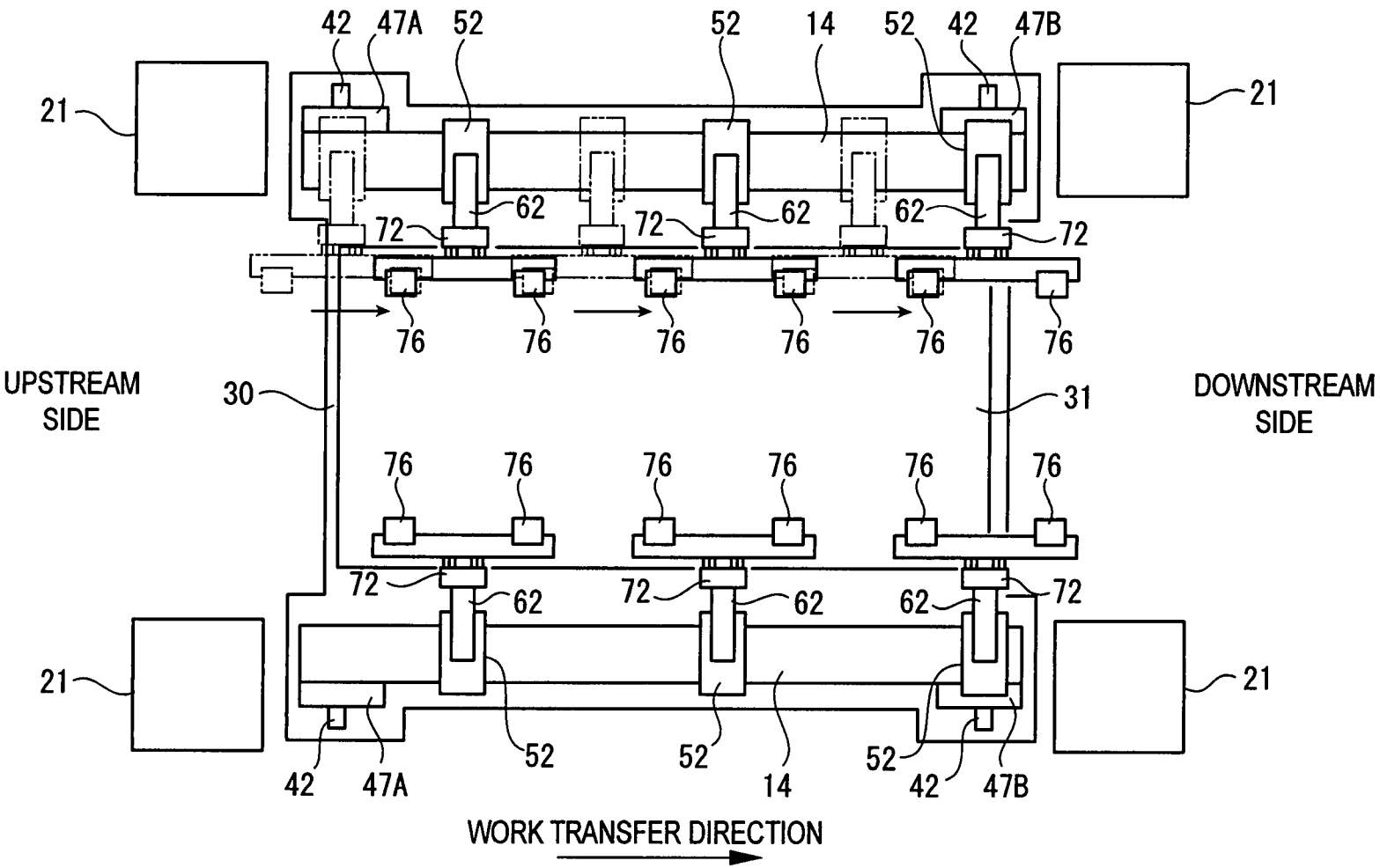
FIG. 10 is a top view showing the transfer feeder, which is the work transfer device of the first embodiment, after the time when the feed operation is performed.

FIG. 10 is a top view of the transfer press 1 illustrating the positions of the feed carriers 52 at the time when a work 81 is carried out from the lowermost stream working process of the transfer press 1 toward the outside of the transfer press 1. In FIG. 10, the respective feed carriers 52 are in the state of having finished the movement for transferring respective works 81 from the positions of the previous stage of working process (the positions shown by alternate long and two short dashes lines in FIG. 10) to the positions of the next stage of working process. In FIG. 10, the fingers 76 in the uppermost stream are positioned in the uppermost stream working process. On the other hand, the fingers 76 in the lowermost stream are positioned outside the bolster 31, namely, are positioned at location that is projected from the bolster 31 and the moving bolster 30. At this time, the fingers 76 in the lowermost stream are positioned on the downstream side relative to the upstream part of the two uprights 21 on the downstream side. This position is the position for performing an idle process for carrying out a work. When the respective fingers 76 transfer the respective works 81 finished with respective stages of working process to the next stage of working process, the fingers 76 which mount the work 81 finished with the lowermost stream working process transfer the work 81 to the outside of the transfer press 1, so that the work 81 is carried outside the transfer press 1.

Figure 11:
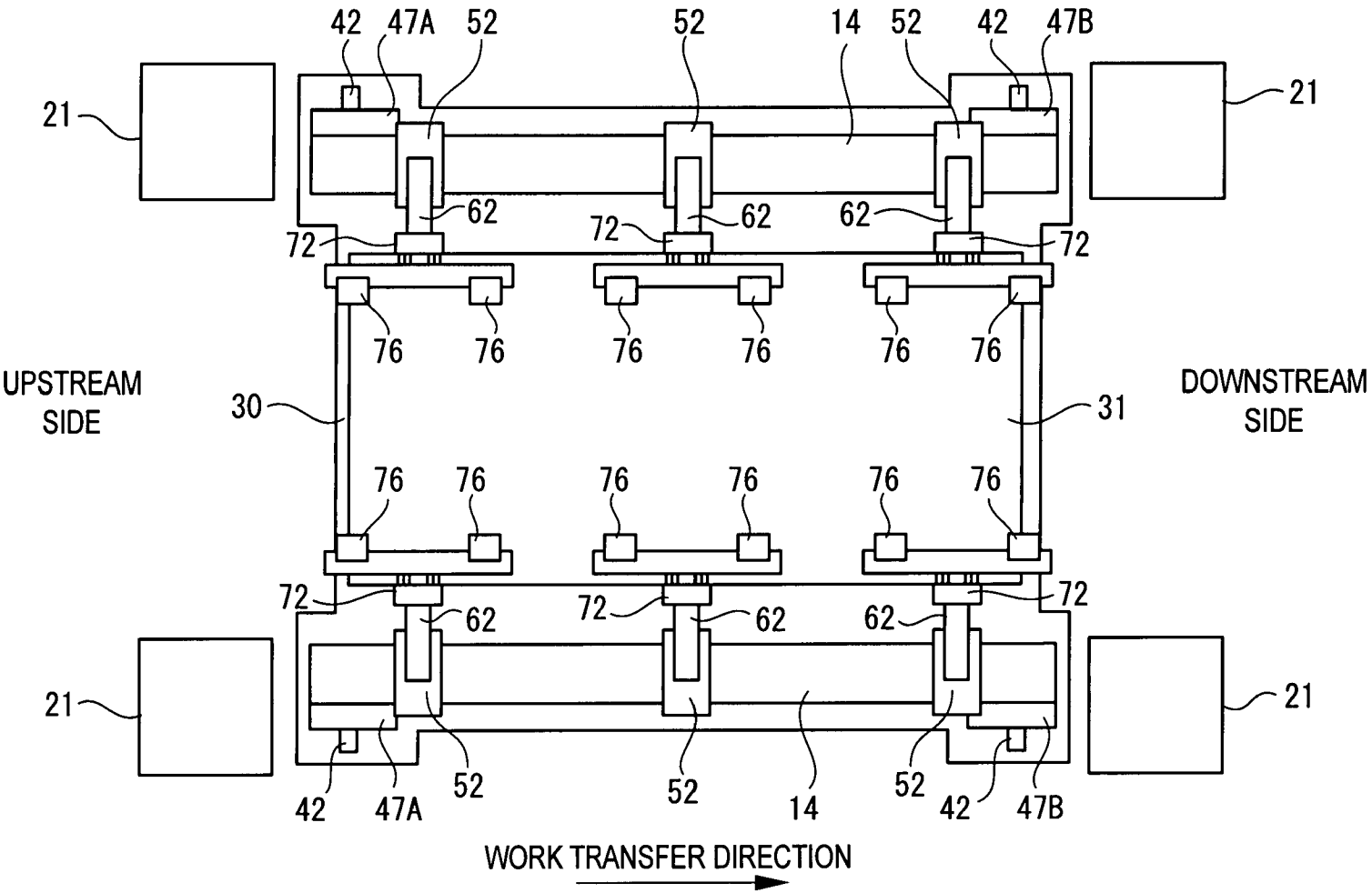
FIG. 11 is a top view showing the transfer feeder, which is the work transfer device of the first embodiment, during the time when the feed operation is performed.

However, since the respective fingers 76 are provided to the moving bolster 30, when performing die exchanging, the fingers have to be carried out from the transfer press 1 along with the moving bolster 30, after passing through between the uprights 21. To solve this problem, when performing die exchanging, the respective feed carriers 52 are moved to the positions as shown in FIG. 11. As shown in FIG. 11, all feed carriers 52 are positioned at respective locations which are not projected from the moving bolster 30 in a plan view of the transfer press 1; namely, all feed carriers 52 are positioned in a space between the uprights 21 on the upstream side and the uprights 21 on the downstream side. In this state, when the moving bolster 30 is moved to pass through the space between the uprights 21 on the upstream side and the uprights 21 on the downstream side, the transfer feeder 41 in its entirety is moved along with the moving bolster 30 so as to be carried outside the transfer press 1. Thus, different from the conventional art, since the bar 14 and feed carriers 52 do not interfere with the uprights 21 when moving the moving bolster 30, the bar 14 needs not to be separated or moved to a height position not interfered with the uprights 21. Accordingly, the die exchanging operation becomes easy.

Also, since the respective feed carriers 52 are movably provided on the feeding rails 51 individually, the interval between the feed carriers 52 can be narrowed in the case where the space between the uprights 21 becomes further narrow, or where the distance of the fingers 76 in the uppermost and the fingers 76 in the lowermost stream is larger than the space between the uprights 21.

Second Embodiment

Figure 12:
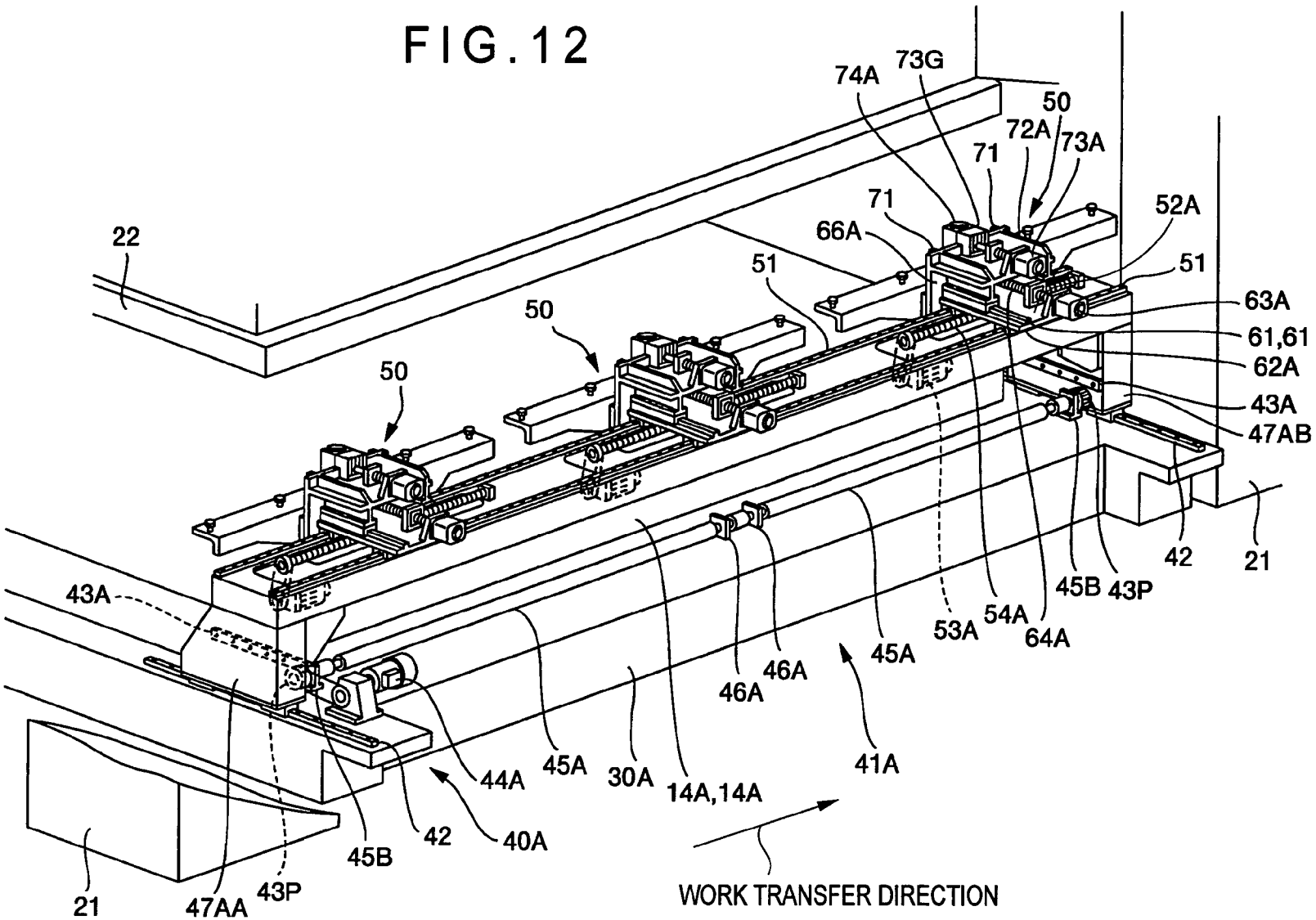
FIG. 12 is a perspective view showing a transfer feeder, which is a work transfer device of a second embodiment.

Next, a transfer feeder 41A of a second embodiment will be described below with reference to FIG. 12. FIG. 12 is a perspective view showing a transfer feeder 41A which is the work transfer device. Like components are denoted by like numerals as of the first embodiment and the explanation thereof will be omitted.

Lower dies 13 (refer to FIG. 2) are attached to an upper surface of a moving bolster 30A opposed to the slide 22, so that a work is press-formed by cooperation of upper dies 12 (refer to FIG. 2) with the lower dies 13. A pair of bars 14A, 14A are provided on the right and left with the upper dies 12 and the lower dies 13 sandwiched therebetween, the pair of bars 14A, 14A extending in parallel in the work transfer direction.

To make the description easy to understand, only one of the pair of the bars 14A, 14A is showed in FIG. 12. As shown in FIG. 12, the front side (seen from FIG. 12) of the automatically movable moving bolster 30A is provided with moving rails 42, 42 respectively in two end portions, and supports 47AA, 47AB, which are respectively arranged below two end portions of the bar 14A, are provided so as to be movable along the moving rails 42, 42.

The supports 47AA, 47AB are respectively provided with racks 43A, 43A, which respectively engage with pinions 43P, 43P. The pinions 43P, 43P are linked with each other via drive shaft 45A, 45A rotatably supported by central supports 46A, 46A. The pinion 43P, 43P are rotatably supported by the moving bolster 30A via bearings 45B, 45B.

When the pinions 43P, 43P rotate, chain-driven by a moving motor 44A provided to the moving bolster 30A, since the pinions 43P, 43P are respectively engaged with the racks 43A, 43A, the bar 14A can be moved along with the supports 47AA, 47AB, and in this manner a bar-interval adjusting device 40A, which can adjust the interval between the pair of bars 14A, 14A (i.e., the bar 14A on the front side and the bar 14A on the back side seen from FIG. 12), is formed.

A pair of feeding rails 51, 51 are provided on an upper surface of the bar 14A, and a plurality of feed carriers 52A are movably provided on the pair of feeding rails 51, 51. Though there are three feed carriers 52A in the second embodiment, the number of the feed carrier 52A can be one, two, four or more than four according to necessity.

The feed carrier 52A, driven by a feeding servomotor (feed drive mechanism) 53A provided to the bar 14A, performs a feed operation. The bar 14A is provided with a ball screw 54A which is chain-driven by the feeding servomotor 53A, and when the ball screw 54A rotates, a ball nut (not shown) provided to the feed carrier 52A moves, so that the feed carrier 52A moves together with the ball nut. In this manner the feed carrier 52A performs a feed operation.

A pair of clamping rails 61, 61 are provided on an upper surface of the feed carrier 52A in a horizontal direction perpendicular to the feeding rail 51, and a clamp carrier 62A is movably provided on the pair of clamping rails 61, 61. The clamp carrier 62A, driven by a clamping servomotor (clamp drive mechanism) 63A provided to the feed carrier 52A, performs a clamp operation.

The feed carrier 52A is provided with a ball screw 64A which is driven by the clamping servomotor 63A, and when the ball screw 64A rotates, a ball nut (not shown) provided to the clamp carrier 62A moves, so that the clamp carrier 62A moves together with the ball nut. In this manner the clamp carrier 62A performs clamp operation.

A pair of lifting rails 71, 71 extending in the vertical direction are provided on the back-side surface (seen from FIG. 12) of an L-shaped bracket 66A of the clamp carrier 62A, and a lift carrier 72A is movably provided on the pair of lifting rails 71, 71. The lift carrier 72A, driven by a lifting servomotor (lift drive mechanism) 73A, performs a lift operation.

The lifting servomotor 73A drives a ball screw 74A, which is rotatably provided to the lift carrier 72A, via a gear box 73G provided to the lift carrier 72A. When the ball screw 74A rotates, a ball nut (not shown) provided to the lift carrier 72A moves, so that the lift carrier 72A moves together with the ball nut. In this manner the lift carrier 72A performs lift operation.

The present embodiment is similar to the first embodiment in that the lift carrier 72A is detachably attached with a pair of fingers as a work holder for holding a work, and the description in this regard will be omitted.

Also, the present embodiment is similar to the first embodiment regarding the operations of the feed carrier 52A, the clamp carrier 62A, and the lift carrier 72A, and the description in these regards will also be omitted.

Similar to the described above, the other bar 14A (not shown) on the back side (seen from FIG. 12) is opposingly provided with feed carriers 52A, lift carriers 72A, and clamp carriers 62A, and all these components respectively perform, driven by respective servomotors, the feed operation, the lift operation, and the clamp operation.

As described above, the transfer feeder 41A of the second embodiment is provided with the feed carrier 52A movable relative to the bar 14A in the feed direction, the clamp carrier 62A movable relative to the feed carrier 52A in the clamp direction, and the lift carrier 72A movable relative to the clamp carrier 62A in the lift direction. All these components are driven by the respective servomotors to respectively perform the feed operation, the clamp operation, and the lift operation under the control of a controller (not shown), so that consequently the transfer feeder 41A operates as a three-dimensional transfer feeder. By appropriately reciprocating the work holder held on the lift carrier 72 in the feed direction, the clamp direction and the lift direction, the work 81 is sequentially transferred from the lower die 13 on an upstream side (left side in FIG. 12) to the lower die 13 on a downstream side (right side in FIG. 12)

Third Embodiment

Figure 13:
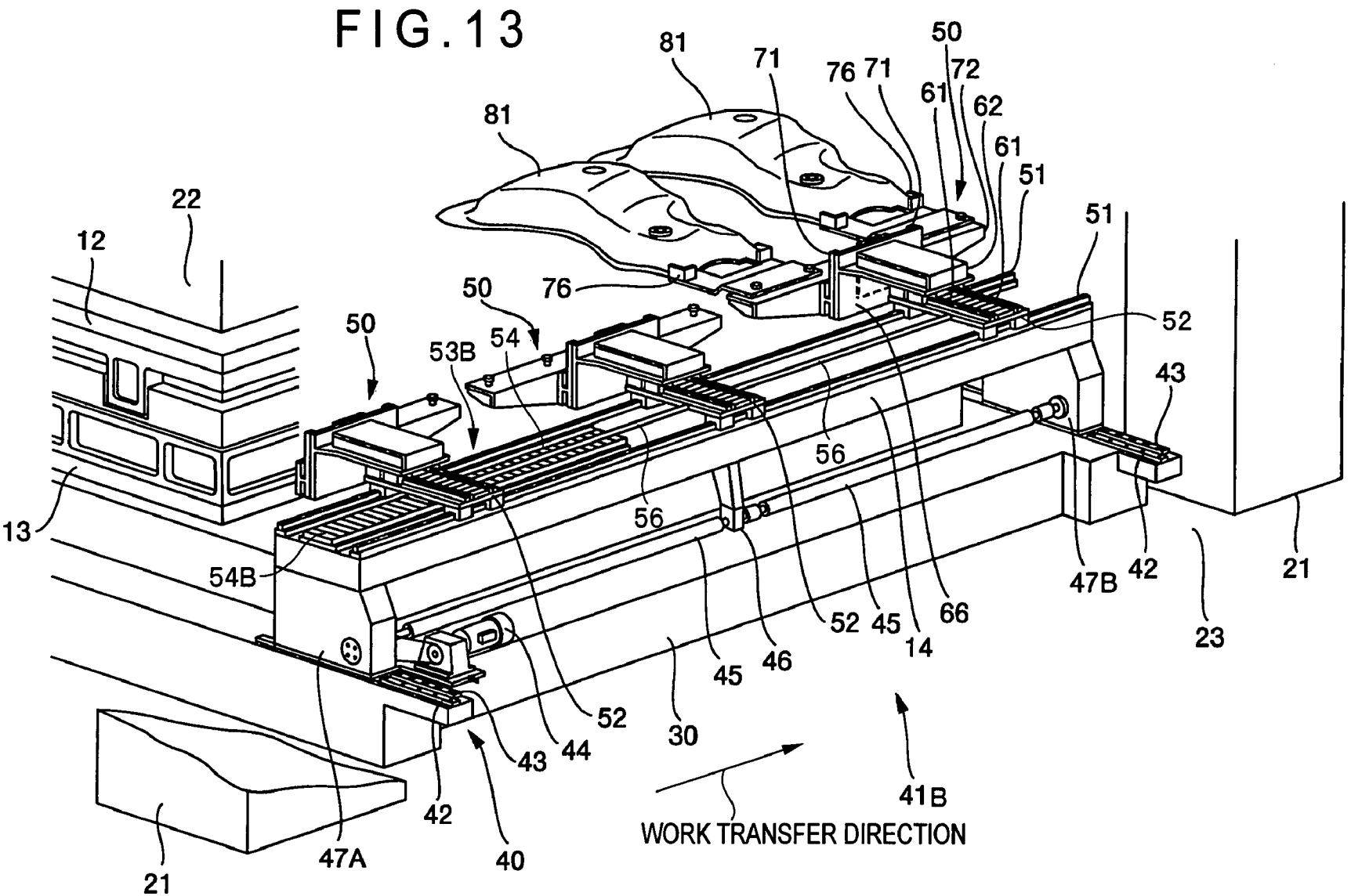
FIG. 13 is a perspective view showing a transfer feeder, which is a work transfer device of a third embodiment.

Next, a transfer feeder 41B of a third embodiment will be described below with reference to FIG. 13. FIG. 13 is a perspective view showing the transfer feeder 41B which is the work transfer device. Like components are denoted by like numerals as of the first embodiment and the explanation thereof will be omitted.

The third embodiment differs from the first embodiment in that the feed carriers 52 adjacent to each other are connected to each other via a connector 56. Accordingly, the plurality of feed carriers 52 are so arranged that the feed carriers 52 adjacent to each other are connected to each other with a predetermined interval. Since all of feed carriers 52 supported by the single bar 14 are operated in an interlocked manner, it is unnecessary to provide a feed drive mechanism for each of the feed carriers 52. FIG. 13 shows a case where only the feed carrier 52 on the upstream side is provided with a linear motor (feed drive mechanism) 53B.

Incidentally, the configuration also can be the one in which all of the feed carriers 52 are respectively provided with linear motors as in the first embodiment, and all of the linear motors are simultaneously driven.

However, in the third embodiment, since the feed carriers 52 adjacent to each other are connected to each other via the connector 56, the interval between the feed carriers 52 can not be reduced. Accordingly, in the case where the space between the uprights 21 is narrow, when performing die exchanging, both the fingers 76 for carrying a work into the uppermost stream working process and the fingers 76 for carrying a work out of the lowermost stream working process can not be carried outside the press machine at the same time. To solve this problem, as shown in FIG. 13, the fingers 76 for carrying a work into the uppermost stream working process can be eliminated, and a separate work carrying-in device (not shown) for carrying a work into the uppermost stream working process can be employed instead. Alternatively, the fingers 76 for carrying a work out of the lowermost stream working process can be eliminated, and a separate work carrying-out device for carrying a work out of the lowermost stream working process can be employed instead.

The present embodiment is similar to the first embodiment regarding the operation of the transfer feeder 41B, and the description in this regard is omitted.

Fourth Embodiment

Figure 14:
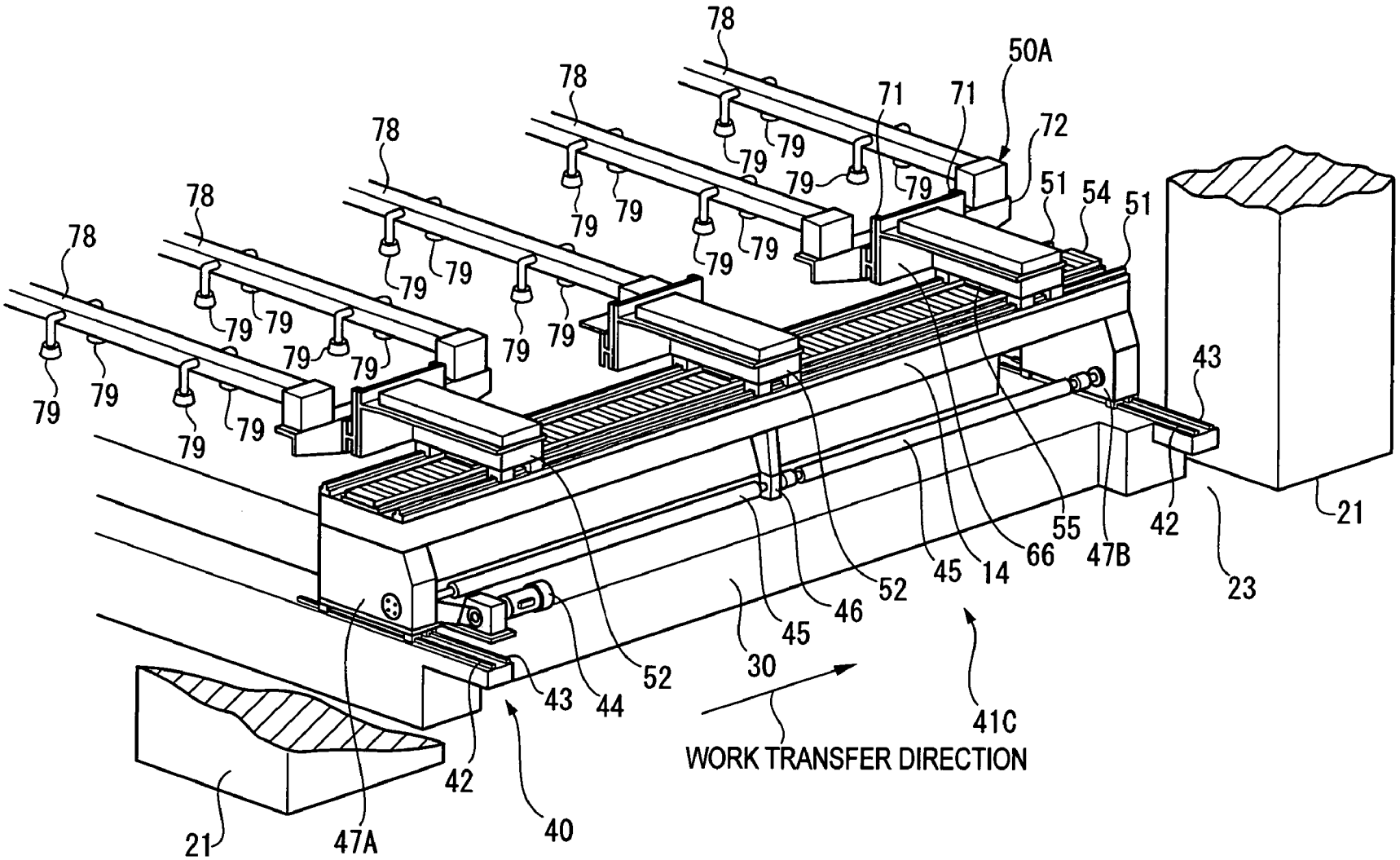
FIG. 14 is a perspective view showing a transfer feeder, which is a work transfer device of a fourth embodiment.

Next, a transfer feeder 41C of a fourth embodiment will be described below with reference to FIG. 14. FIG. 14 is a perspective view showing the transfer feeder 41C which is the work transfer device. Like components are denoted by like numerals as of the first embodiment and the explanation thereof will be omitted.

The fourth embodiment differs from the first embodiment in that the clamping linear motor 63 is eliminated, and the lift carrier 72 is held by the feed carrier 52. With such a configuration, a pair of right and left lift carriers 72 have constant interval therebetween, and cross bars 78 are horizontally stretched between the pairs of lift carriers 72. The cross bar 78 is provided with vacuum cups (work holders) 79 for sucking and holding the work by the negative pressure. In the fourth embodiment, since the vacuum cups 79 are held by the lift carrier 72 via the cross bar 78, and the lift carrier 72 can move in lift direction, so that the lift carrier 72 is equivalent to a base 50A of the present invention.

With such a configuration, the feed carrier 52 performs the feed motion and the lift carrier 72 performs the lift motion, therefore the transfer feeder 41C of the fourth embodiment can perform two-dimensional operation.

Figure 15:
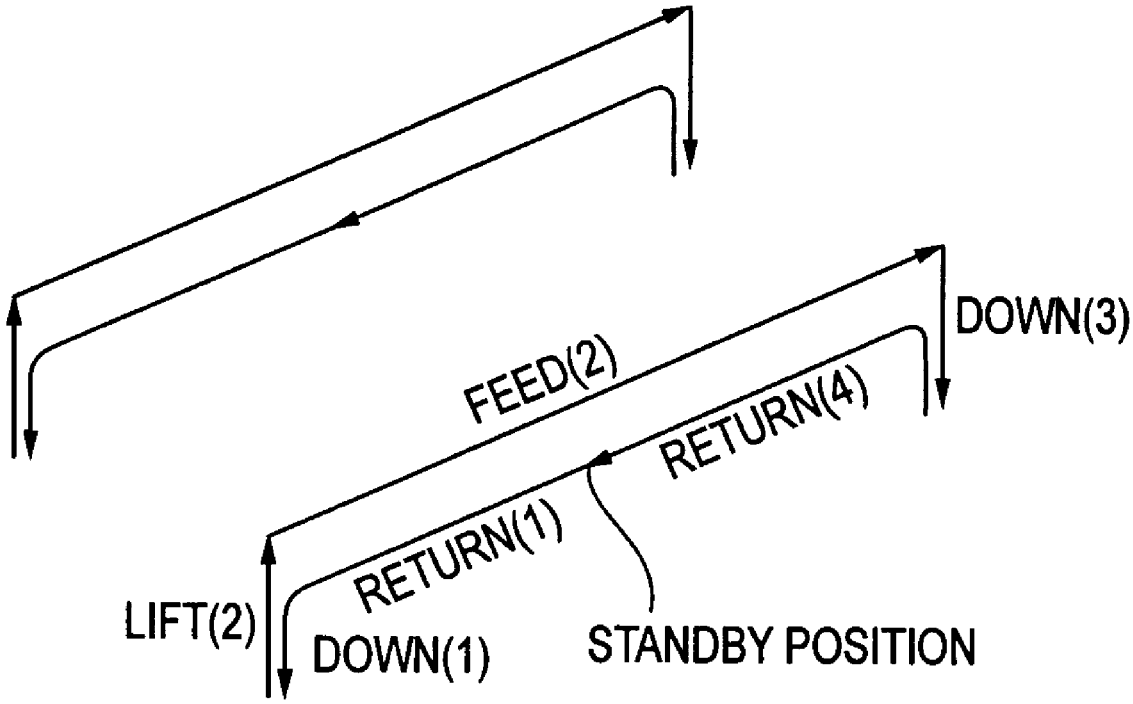
FIG. 15 is an illustration explaining the motion of a work holder of the fourth embodiment.

The operation of the work transfer device in the fourth embodiment will be described below with reference to FIG. 14 and FIG. 15 that explains the motion of the fourth embodiment. The operation will be described based on a case where a work is transferred from a first working process to a second working process.

(1) First, the work 81 is pressed in the first working process, and the slide 22 starts to rise.

At this time, the cross bar 78 provided on the lift carrier 72 is located in a standby position in the middle between the first working process and the second working process. In the standby position, the lift carrier 72 is located in a lift position (at the upward end of a lift stroke). After the press working is finished, the feed carrier 52 that holds the lift carrier 72 is subjected to a controlled drive to perform a return motion toward the side of the first working process. And the cross bar 78 is moved from the standby position to the first working process.

Next, the lift carrier 72 is descended to a down position (at the downward end of a lift stroke), and the work 81 on the lower die 13 of the first working process is sucked and held by the vacuum cups 79 of the cross bar 78.

(2) Next, in the state where the work 81 is sucked and held by the vacuum cups 79, the lift carrier 72 performs lift motion to a lift position (at the upward end of a lift stroke). Further, the feed carrier 52 is subjected to a controlled drive to perform a feed motion. Thus the work 81 sucked and held by the vacuum cup 79 is transferred from the first working process to the second working process.

(3) Upon the work 81 reaches the second working process, the lift carrier 72 is moved to the down position to set the work 81 onto the lower die 13 of the second working process. And the sucking force of the vacuum cup 79 is released.

(4) After the work 81 is set onto the lower die 13, the lift carrier 72 is moved to the lift position and the feed carrier 52 is subjected to a controlled drive to perform a return motion toward the initial standby position.

Incidentally, after the cross bar 78 is moved to the standby position and retreated from the area of interfering with the upper die 12, the slide 22 is descended, so that a predetermined press working of the second working process is performed by clamping the work 81 between the upper die 12 attached on the lower surface of the slide 22 and the lower die 13 and applying pressure.

As described above, the transfer feeder 41C of the fourth embodiment is provided with the feed carrier 52 movable relative to the bar 14 in the feed direction, and the lift carrier 72 movable relative to the feed carrier 52 in the lift direction. All these components are driven by the respective linear motors to respectively perform, in a reciprocating manner, the feed/return motion in the feed direction, and the rising/descending motion in the lift direction. All these motions constitute a two dimensional operation. By appropriately reciprocating the cross bar 78 installed to the lift carrier 72 and the vacuum cups 79 installed to the cross bar 78 in the feed direction and the lift direction, the work 81 is sequentially transferred from the lower die 13 on an upstream side (left side in FIG. 14) to the lower die 13 on a downstream side (right side in FIG. 14).

Figure 16:
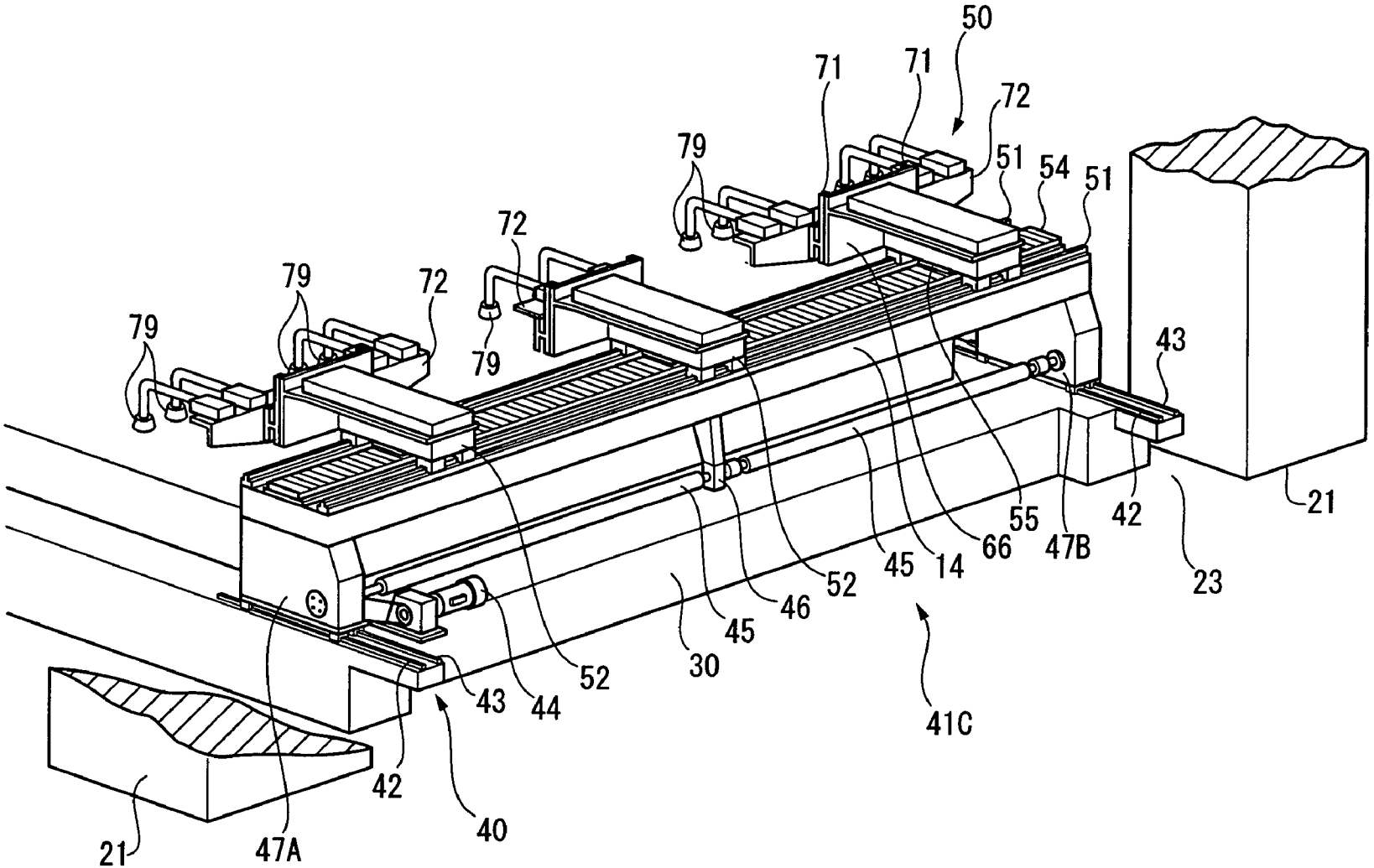
FIG. 16 is a perspective view showing a transfer feeder, which is a work transfer device of another example of the fourth embodiment.
Figure 17:
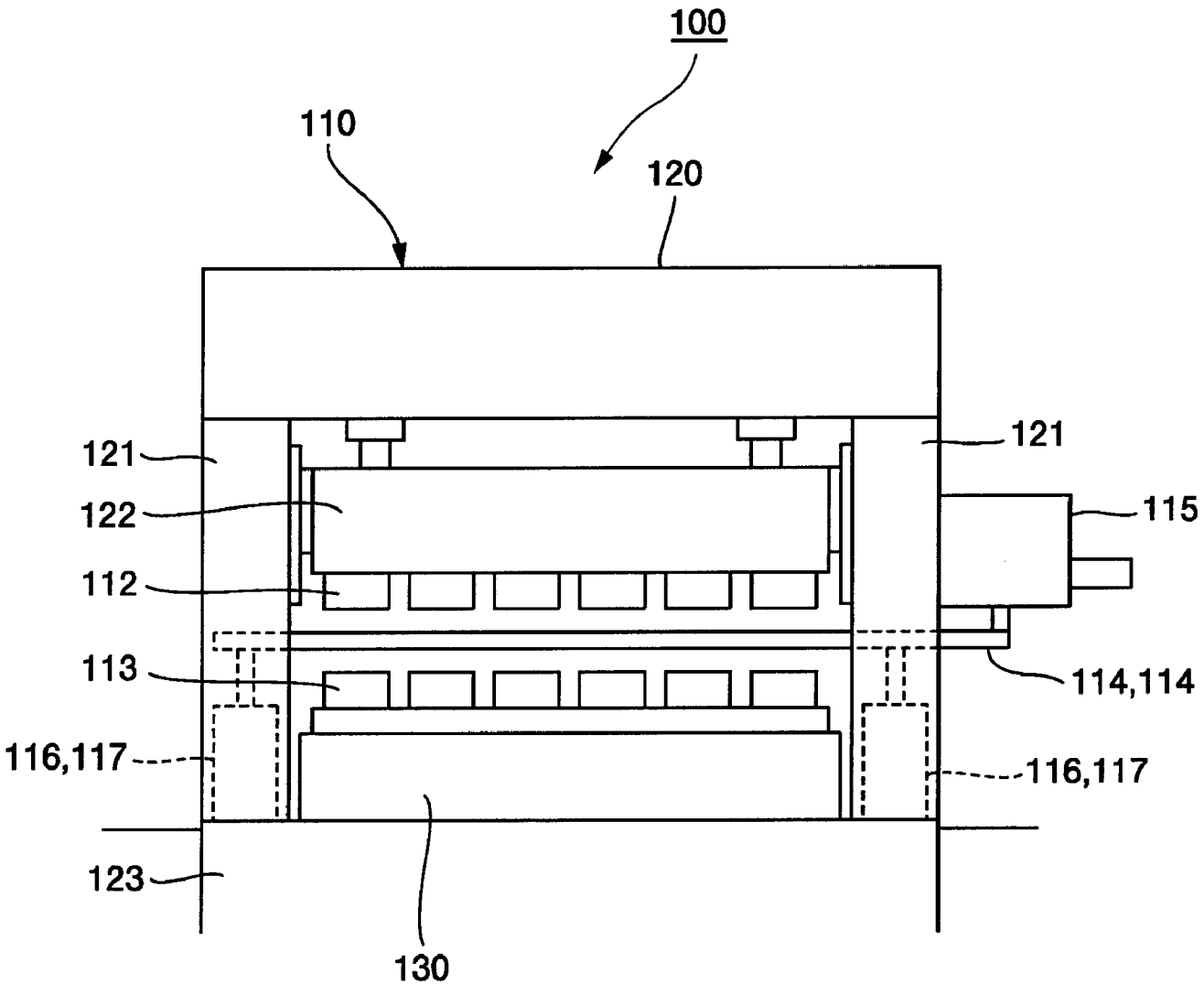
FIG. 17 is a front elevational view showing a conventional press machine.

Incidentally, though the vacuum cups 79 as work holders are installed to the cross bar 78 in the fourth embodiment, the vacuum cups 79 can also be installed to the lift carrier 72 as shown in FIG. 16.

Further, in the fourth embodiment, the clamping linear motor 63 is eliminated compared to the first embodiment, but the configuration also can be the one in which the configuration is the same as the first embodiment but with the drive of the clamping linear motor 63 stopped so that the cross bar 78 and the vacuum cups 79 perform two-dimensional operation.

Also, though either linear motors or servomotors are employed for the respective drive mechanisms in the previous embodiments, a combination of the linear motor and servomotor can also be employed. For example, the work holder can be moved by using a linear motor to perform the feed motion and a servomotor to perform the lift motion and the clamp motion, and at least one driving source is linear motor. Also, the work holder can be moved by using servomotor to perform the feed motion and linear motor to perform the lift motion and the clamp motion, and at least one driving source is servomotor. In other words, the linear motor and the servomotor can be used as the driving source for feeding, clamping, and lifting according to necessity.

Further, each of the plural work holders which perform three-dimensional operation relative to the bar 14 can individually move under the control of a controller (not shown). Thus various motion patterns can be easily prepared. In other words, the operation of respective feeding linear motors 53, 53, 53, which respectively drive the feed carriers 52, 52, 52 of the first embodiment, can be individually controlled by the controller (not shown) so that different feeding speed and stroke can be respectively set. The same goes for the servomotors of the second embodiment when they are individually driven. And the same also goes for the lift motion and clamp motion when the respective carriers are individually driven.

Further, since the feed box having a feed drive section housed therein becomes unnecessary, there is no feed box projected from the lateral surface of the press main body, so that the press device as a whole can be downsized. Further, since no feed box is projected, a robot or the like for carrying out the work can be provided in the vicinity of the press machine.

Further, not only the feed box is unnecessary, since the lift box and the clamp box, arranged on the bed 23 between the right and left uprights 21 and each respectively having a lift drive section and a clamp drive section housed therein, also become unnecessary, the construction of the press machine is simplified, and the manufacturing cost is reduced.

Incidentally, though the above description is based on a so called two-pillar type transfer press machine which has four uprights and one slide, the present invention also can be applied to a so called three-pillar type transfer press machine which has six uprights and two slides, or to other transfer press machine which has more uprights and slides.

Incidentally, effect of the present invention also can be obtained in retrofitting.

As a recent trend in the field of the transfer press machine, retrofitting of the press machine is actively carried out, such as retrofitting an existing press machine by changing a cam actuated work transfer device thereof with a work transfer device subjected to servo control driving, so that the function of the press machine can be improved in terms of speed, capability for coping with various works, and the like. However, in a conventional retrofitting of the press machine, even if a servomotor is used for the driving source in feed direction, since the feed box is projected from the lateral surface of the press main body on the work carrying-out side (or the work carrying-in side), the feed box, which is a main part of the feed device, still remains there, the retrofitting work is actually a work for changing the feed box as a result. Since the feed box is large and heavy, and since the feed box is projected from the lateral surface of the press main body, a number of working days will be necessary for exchanging the feed box (including the work for welding a feed box mounting seat onto the press main body).

Further, since the operation of the process line has to be stopped for long time to perform such retrofitting work, the production of the user will be disturbed.

In the present invention, since the work transfer device is arranged in its entirety on the moving bolster, it is unnecessary to install a feed box, a clamp box, and a lift box to the press main body. Therefore when performing retrofitting work on the press machine, the only needed is minimum modification, such as modifying or restructuring the moving bolster, and detaching the unnecessary device from the press main body. Thus working days for retrofitting can be reduced, and impact to production efficiency of the user can be minimized.

Also, though the preferred configurations, methods and the like for carrying out the present invention are described above, the present invention is not intended to be limited thereto. In other words, though the present invention is mainly illustrated and described based on specific embodiment thereof, it should be understood that various changes in the shape, material, quantity, and other details of construction can be made by those skilled in the art based on the embodiment described above without departing from the spirit and objects of technical characteristics of the present invention.

Accordingly, the description disclosed above, which gives specific shape, material and the like, is just an exemplary description to make the present invention well understood instead of being a definition of the limits of the invention, therefore the description based on a component name without part or all of the specific shape, material and the like is included in the present invention.

INDUSTRIAL APPLICABILITY

With the work transfer device for press machines as described in present invention, since a large driving mechanism is not necessary, the construction can be simplified. Further, since the work transfer device is arranged in its entirety on the moving bolster, die exchanging can be easily performed. Accordingly, the present invention also can be applied to a press machine which mounts various kinds of dies.

The invention claimed is:

1. A work transfer device for press machines, comprising:

a pair of bars fixed on a moving bolster in parallel with a work transfer direction;

a feed carrier held by each of the pair of bars in a manner movable along the bars;

a feed drive mechanism for driving the feed carrier along the bars in the work transfer direction;

a base provided on the feed carrier in a manner movable in a lift direction;

a lift drive mechanism for driving the base in the lift direction so that the base moves vertically; and a work holder detachably attached to the base for holding a work.

2. The work transfer device for press machines according to claim 1, further comprising a clamp drive mechanism for driving the base in a clamp direction horizontally orthogonal to the work transfer direction.

3. The work transfer device for press machines according to claim 1, wherein at least one of the feed drive mechanism and the lift drive mechanism is provided with a linear motor.

4. The work transfer device for press machines according to claim 2, wherein the clamp drive mechanism is provided with a linear motor.

5. The work transfer device for press machines according to claim 1, wherein at least one of the feed drive mechanism and the lift drive mechanism is provided with a servomotor.

6. The work transfer device for press machines according to claim 2, wherein the clamp drive mechanism is provided with a servomotor.

7. The work transfer device for press machines according to claim 1, wherein a plurality of the work holders for plural working processes are detachably attached to the base.

8. The work transfer device for press machines according to claim 1, further comprising a bar-interval adjusting device, provided on the moving bolster, for adjusting an interval between the pair of bars.

9. The work transfer device for press machines according to claim 1, wherein the feed carrier is movable to a position where the work holder is not projected from the moving bolster in a plan view of the press machine.

10. The work transfer device for press machines according to claim 2, wherein at least one of the feed drive mechanism and the lift drive mechanism is provided with a linear motor.

11. The work transfer device for press machines according to claim 2, wherein at least one of the feed drive mechanism and the lift drive mechanism is provided with a servomotor.

12. The work transfer device for press machines according to claim 2, wherein a plurality of the work holders for plural working processes are detachably attached to the base.

13. The work transfer device for press machines according to claim 2, further comprising a bar-interval adjusting device, provided on the moving bolster, for adjusting an interval between the pair of bars.

14. The work transfer device for press machines according to claim 2, wherein the feed carrier is movable to a position where the work holder is not projected from the moving bolster in a plan view of the press machine.

15. A work transfer device for press machines, comprising:

a pair of bars fixed on a moving bolster in parallel with a work transfer direction;

a plurality of feed carriers held by each of the pair of bars in a manner movable along the bars;

a feed drive mechanism for driving the plurality of feed carriers along the bars in the work transfer direction, the feed drive mechanism controlling individual movement of each of the plurality of feed carriers;

a base provided on the feed carrier in a manner movable in a lift direction;

a lift drive mechanism for driving the base in the lift direction so that the base moves vertically; and a work holder detachably attached to the base for holding a work.

16. The work transfer device for press machines according to claim 15, further comprising a bar-interval adjusting device, provided on the moving bolster, for adjusting an interval between the pair of bars.

17. A work transfer device for press machines, comprising:

a pair of bars fixed on a moving bolster in parallel with a work transfer direction;

a plurality of feed carriers held by each of the pair of bars in a manner movable along the bars;

a feed drive mechanism for driving the plurality of feed carriers along the bars in the work transfer direction;

a base provided on the feed carrier in a manner movable in a lift direction;

a lift drive mechanism for driving the base in the lift direction so that the base moves vertically; and a work holder detachably attached to the base for holding a work.

18. The work transfer device for press machines according to claim 17, further comprising a bar-interval adjusting device, provided on the moving bolster, for adjusting an interval between the pair of bars.

19. A work transfer device for press machines, comprising:

a pair of bars fixed on a moving bolster in parallel with a work transfer direction;

a plurality of feed carriers held by each of the pair of bars in a manner movable along the bars;

a feed drive mechanism for driving the plurality of feed carriers along the bars in the work transfer direction, the feed drive mechanism controlling individual movement of each of the plurality of feed carriers;

a base provided on the feed carrier in a manner movable in a lift direction and in a clamp direction horizontally orthogonal to the work transfer direction;

a lift drive mechanism for driving the base in the lift direction so that the base moves vertically;

a clamp drive mechanism for driving the base in the clamp direction; and a work holder detachably attached to the base for holding a work.

20. The work transfer device for press machines according to claim 19, further comprising a bar-interval adjusting device, provided on the moving bolster, for adjusting an interval between the pair of bars.

21. A work transfer device for press machines, comprising:

a pair of bars fixed on a moving bolster in parallel with a work transfer direction;

a plurality of feed carriers held by each of the bars in a manner movable along the bars;

a feed drive mechanism for driving the plurality of feed carriers along the bars in the work transfer direction;

a connector for connecting adjacent ones of the plurality of feed carriers;

a base provided on the feed carrier in a manner movable in a lift direction and in a clamp direction horizontally orthogonal to the work transfer direction;

a lift drive mechanism for driving the base in the lift direction so that the base moves vertically;

a clamp drive mechanism for driving the base in the clamp direction; and a work holder detachably attached to the base for holding a work.

22. The work transfer device for press machines according to claim 21, further comprising a bar-interval adjusting device, provided on the moving bolster, for adjusting an interval between the pair of bars.

* * * * *